US009441818B2

(12) United States Patent
Dixon et al.

(10) Patent No.: US 9,441,818 B2
(45) Date of Patent: Sep. 13, 2016

(54) UPLIGHT WITH SUSPENDED FIXTURE

(71) Applicant: CREE, INC., Durham, NC (US)

(72) Inventors: Mark Edward Dixon, Morrisville, NC (US); Kurt W Wilcox, Libertyville, IL (US)

(73) Assignee: CREE, INC., Durham, NC (US)

( * ) Notice: Subject to any disclaimer, the term of this patent is extended or adjusted under 35 U.S.C. 154(b) by 0 days.

(21) Appl. No.: 13/899,314

(22) Filed: May 21, 2013

(65) Prior Publication Data

US 2014/0126193 A1 May 8, 2014

Related U.S. Application Data

(63) Continuation-in-part of application No. 13/840,812, filed on Mar. 15, 2013, and a continuation of application No. 13/782,820, filed on Mar. 1, 2013, and a continuation-in-part of application No. 13/672,592, filed on Nov. 8, 2012, and a continuation-in-part of application No. 13/842,150, filed on Mar. 15, 2013.

(51) Int. Cl.

| | |
|---|---|
| ***F21V 21/00*** | (2006.01) |
| ***F21S 8/06*** | (2006.01) |
| ***F21V 3/02*** | (2006.01) |

(Continued)

(52) U.S. Cl.

CPC ..... *F21V 21/00* (2013.01); *F21S 8/063* (2013.01); *F21V 3/02* (2013.01); *F21V 7/005* (2013.01); *F21V 7/0016* (2013.01);

(Continued)

(58) Field of Classification Search

CPC ..... F21V 21/02; F21V 21/025; F21V 21/03; F21V 21/00; F21V 5/04; F21V 17/164; F21V 3/02; F21V 7/0016; F21V 7/005; F21V 3/00; F21V 5/00; F21V 5/08

See application file for complete search history.

(56) References Cited

U.S. PATENT DOCUMENTS 4,118,763 A * 10/1978 Osteen ..... F21S 8/06 359/833
4,300,185 A 11/1981 Wakamatsu ..... 362/147

(Continued)

FOREIGN PATENT DOCUMENTS

DE WO 2008003289 1/2008
DE 102007030186 1/2009

(Continued)

OTHER PUBLICATIONS

Office Action from U.S. Appl. No. 29/449,316, dated Jun. 5, 2014.

(Continued)

*Primary Examiner* — Bao Q Truong
(74) *Attorney, Agent, or Firm* — Koppel, Patrick, Heybl & Philpott

(57) ABSTRACT

This disclosure relates to lighting fixtures, such as suspended lighting fixtures. Devices according to the present disclosure provide lighting fixtures capable of emitting in one or more primary directions, while simultaneously emitting in a direction toward a mount surface, reducing undesirable areas of insufficient light and more efficiently illuminating a space. Lighting fixtures disclosed herein can achieve this increase in illumination efficiency in many ways, including utilizing various lighting element arrangements, such as dual-sided lighting elements, and various lens arrangements, such as lens shape affecting the direction of emitted light.

22 Claims, 12 Drawing Sheets

(51) Int. Cl.

| | |
|---|---|
| ***F21V 7/00*** | (2006.01) |
| ***F21V 17/16*** | (2006.01) |
| *F21Y 101/02* | (2006.01) |
| *F21Y 103/00* | (2016.01) |

(52) U.S. Cl.

CPC ..... *F21V 17/164* (2013.01); *F21Y 2101/02* (2013.01); *F21Y 2103/003* (2013.01)

(56) References Cited

U.S. PATENT DOCUMENTS

| | | | | |
|---|---|---|---|---|
| 4,464,707 | A * | 8/1984 | Forrest | F21S 8/036 362/217.06 |
| 4,472,767 | A * | 9/1984 | Wenman | F21S 8/06 362/147 |
| 4,946,547 | A | 8/1990 | Palmour et al. | |
| 5,200,022 | A | 4/1993 | Kong et al. | |
| RE34,861 | E | 2/1995 | Davis et al. | |
| 5,530,628 | A | 6/1996 | Ngai | 362/127 |
| 5,690,415 | A | 11/1997 | Krehl | 362/125 |
| 5,823,663 | A | 10/1998 | Bell et al. | 362/362 |
| 5,951,150 | A | 9/1999 | Helstern | 362/293 |
| 6,210,025 | B1 | 4/2001 | Schmidt et al. | 362/362 |
| 6,435,697 | B1 | 8/2002 | Simmons | 362/219 |
| 6,536,924 | B2 | 3/2003 | Segretto | 362/247 |
| 6,667,451 | B1 | 12/2003 | Hart | 200/314 |
| 6,739,734 | B1 | 5/2004 | Hulgan | 362/243 |
| 6,914,194 | B2 | 7/2005 | Fan | |
| 7,049,761 | B2 | 5/2006 | Timmermans et al. | 315/246 |
| 7,131,747 | B1 * | 11/2006 | Yates | G09F 13/22 362/219 |
| 7,213,940 | B1 | 5/2007 | Van de Ven et al. | 362/231 |
| 7,217,023 | B2 | 5/2007 | Iwasa et al. | 362/555 |
| 7,228,253 | B2 * | 6/2007 | Chen | G02B 23/16 318/11 |
| 7,387,410 | B2 | 6/2008 | Sibout | 362/375 |
| 7,510,299 | B2 | 3/2009 | Timmermans et al. | 362/225 |
| 7,540,627 | B2 | 6/2009 | Handsaker | 362/225 |
| 7,594,736 | B1 | 9/2009 | Kassay et al. | |
| 7,628,506 | B2 | 12/2009 | Verfuerth et al. | 362/218 |
| 7,654,702 | B1 | 2/2010 | Ding et al. | |
| 7,654,703 | B2 | 2/2010 | Kan et al. | 362/362 |
| 7,712,918 | B2 | 5/2010 | Siemiet et al. | 362/241 |
| 7,722,220 | B2 | 5/2010 | Van de Ven | 362/294 |
| 7,758,207 | B1 | 7/2010 | Zhou | 362/217.1 |
| 7,768,192 | B2 | 8/2010 | Van de Ven et al. | 313/503 |
| 7,791,061 | B2 | 9/2010 | Edmond et al. | |
| 7,815,338 | B2 | 10/2010 | Siemiet et al. | 362/218 |
| 8,058,088 | B2 | 11/2011 | Cannon et al. | |
| 8,092,049 | B2 | 1/2012 | Kinnune et al. | 362/294 |
| 8,201,968 | B2 | 6/2012 | Maxik et al. | |
| 8,206,004 | B2 | 6/2012 | Serak et al. | 362/217 |
| 8,220,953 | B1 | 7/2012 | Moore | 362/217.01 |
| 8,313,212 | B1 | 11/2012 | Mayer et al. | 362/219 |
| 8,317,369 | B2 | 11/2012 | McCanless | 362/368 |
| 8,342,714 | B1 | 1/2013 | Rea | 362/264 |
| 8,376,578 | B2 | 2/2013 | Kong, II | 362/241 |
| 8,459,824 | B1 | 6/2013 | Esmailzadeh et al. | 362/147 |
| 8,523,383 | B1 | 9/2013 | Grigore et al. | 362/221 |
| 8,714,770 | B2 | 5/2014 | Kato | 362/217.06 |
| 8,764,220 | B2 | 7/2014 | Chan et al. | 362/217.02 |
| 9,057,493 | B2 * | 6/2015 | Simon | F21K 9/17 |
| 2001/0048599 | A1 | 12/2001 | Hess | 362/290 |
| 2004/0001344 | A1 | 1/2004 | Hecht | |
| 2004/0240214 | A1 | 12/2004 | Whitlow et al. | 362/373 |
| 2004/0252521 | A1 * | 12/2004 | Clark | F21V 5/00 362/554 |
| 2005/0041418 | A1 | 2/2005 | Fan | 362/217.05 |
| 2005/0146867 | A1 * | 7/2005 | Kassay | F21V 7/0016 362/217.05 |
| 2006/0050505 | A1 | 3/2006 | McCarthy | 362/219 |
| 2006/0266955 | A1 | 11/2006 | Arvin | 250/492.1 |
| 2006/0278882 | A1 | 12/2006 | Leung | 257/98 |
| 2007/0158668 | A1 | 7/2007 | Tarsa et al. | |
| 2008/0049422 | A1 | 2/2008 | Trenchard et al. | |
| 2008/0128723 | A1 | 6/2008 | Pang | |
| 2008/0173884 | A1 | 7/2008 | Chitnis et al. | |
| 2008/0179611 | A1 | 7/2008 | Chitnis et al. | |
| 2008/0232093 | A1 | 9/2008 | Kim | |
| 2008/0258130 | A1 | 10/2008 | Bergmann et al. | |
| 2008/0285267 | A1 * | 11/2008 | Santoro | F21V 5/02 362/224 |
| 2008/0314944 | A1 | 12/2008 | Tsai | 224/331 |
| 2009/0040782 | A1 | 2/2009 | Liu et al. | 362/555 |
| 2009/0046457 | A1 | 2/2009 | Everhart | 362/235 |
| 2009/0161356 | A1 | 6/2009 | Negley et al. | 362/231 |
| 2009/0184333 | A1 | 7/2009 | Wang et al. | |
| 2009/0207602 | A1 | 8/2009 | Reed et al. | 362/225 |
| 2009/0212304 | A1 | 8/2009 | Wang et al. | |
| 2009/0224265 | A1 | 9/2009 | Wang et al. | |
| 2009/0237958 | A1 | 9/2009 | Kim | |
| 2009/0290345 | A1 * | 11/2009 | Shaner | 362/249.01 |
| 2009/0290348 | A1 | 11/2009 | Van Laanen et al. | 362/249 |
| 2009/0296381 | A1 | 12/2009 | Dubord | 362/218 |
| 2010/0002426 | A1 | 1/2010 | Wu | 362/223 |
| 2010/0110701 | A1 | 5/2010 | Liu | 362/373 |
| 2010/0128485 | A1 | 5/2010 | Teng | 362/294 |
| 2010/0142205 | A1 * | 6/2010 | Bishop | 362/249.02 |
| 2010/0155763 | A1 | 6/2010 | Donofrio et al. | |
| 2010/0171404 | A1 | 7/2010 | Liu et al. | 313/46 |
| 2010/0214770 | A1 | 8/2010 | Anderson | 362/133 |
| 2010/0214785 | A1 | 8/2010 | Chen | 362/267 |
| 2010/0220469 | A1 | 9/2010 | Ivey et al. | 362/218 |
| 2010/0254146 | A1 | 10/2010 | McCanless | |
| 2010/0259927 | A1 | 10/2010 | Chien | 362/235 |
| 2010/0328945 | A1 | 12/2010 | Song et al. | 362/240 |
| 2011/0006688 | A1 * | 1/2011 | Shim | F21K 9/17 315/119 |
| 2011/0007514 | A1 | 1/2011 | Sloan | 362/368 |
| 2011/0013400 | A1 | 1/2011 | Kanno et al. | |
| 2011/0028006 | A1 | 2/2011 | Shah et al. | 439/39 |
| 2011/0090682 | A1 | 4/2011 | Zheng | 362/218 |
| 2011/0103043 | A1 | 5/2011 | Ago | 362/147 |
| 2011/0163683 | A1 * | 7/2011 | Steele et al. | 315/192 |
| 2011/0199005 | A1 | 8/2011 | Bretschneider et al. | |
| 2011/0199769 | A1 | 8/2011 | Bretschneider et al. | |
| 2011/0211330 | A1 | 9/2011 | Wang | 362/20 |
| 2011/0285314 | A1 | 11/2011 | Carney et al. | 315/294 |
| 2011/0286207 | A1 | 11/2011 | Chan et al. | 362/217.1 |
| 2011/0286208 | A1 | 11/2011 | Chen | 362/217.1 |
| 2011/0310604 | A1 * | 12/2011 | Shimizu et al. | 362/235 |
| 2011/0310614 | A1 | 12/2011 | Budike, Jr. | 362/294 |
| 2012/0002408 | A1 | 1/2012 | Lichten et al. | 362/218 |
| 2012/0051041 | A1 | 3/2012 | Edmond | 362/231 |
| 2012/0075857 | A1 | 3/2012 | Verbrugh | 362/249 |
| 2012/0081883 | A1 | 4/2012 | Wang | 362/101 |
| 2012/0098424 | A1 | 4/2012 | Arik | 315/35 |
| 2012/0120666 | A1 * | 5/2012 | Moeller | 362/308 |
| 2012/0169234 | A1 | 7/2012 | Shew | 315/88 |
| 2012/0182755 | A1 | 7/2012 | Wildner | 362/555 |
| 2012/0218757 | A1 | 8/2012 | Gill | 362/235 |
| 2012/0235199 | A1 | 9/2012 | Andrews et al. | |
| 2012/0250302 | A1 | 10/2012 | Edwards | 362/223 |
| 2013/0039090 | A1 | 2/2013 | Dau | 362/551 |
| 2013/0050998 | A1 | 2/2013 | Chu et al. | 362/218 |
| 2013/0094225 | A1 | 4/2013 | Leichner | 362/368 |
| 2013/0155670 | A1 | 6/2013 | Handsaker | 362/223 |
| 2013/0258616 | A1 | 10/2013 | Chao | 361/752 |
| 2013/0271979 | A1 | 10/2013 | Pearson et al. | 362/235 |
| 2013/0279156 | A1 | 10/2013 | Kaule | 362/133 |
| 2013/0279180 | A1 | 10/2013 | Pearson et al. | 362/371 |
| 2013/0329425 | A1 | 12/2013 | Lowes et al. | |
| 2014/0085861 | A1 | 3/2014 | Nicolai | 362/84 |
| 2014/0265809 | A1 | 9/2014 | Hussell | |
| 2015/0016100 | A1 | 1/2015 | Ishii | 362/223 |

FOREIGN PATENT DOCUMENTS

| | | | |
|---|---|---|---|
| DE | 202010001832 | | 7/2010 |
| EP | 1298383 | A2 | 4/2003 |
| EP | 1357335 | A2 | 10/2003 |
| EP | 1847762 | A2 | 10/2007 |
| JP | 2011018571 | | 8/2011 |
| JP | 2011018572 | | 8/2011 |

(56) References Cited

FOREIGN PATENT DOCUMENTS

| | | | |
|---|---|---|---|
| WO | WO 03102467 | | 12/2003 |
| WO | WO 2009140761 | A1 | 11/2009 |
| WO | WO 2010042216 | A2 | 4/2010 |
| WO | WO 2011074424 | A1 | 6/2011 |
| WO | WO 2011096098 | A1 | 8/2011 |
| WO | WO 2011140353 | A2 | 11/2011 |

OTHER PUBLICATIONS

Office Action from U.S. Appl. No. 13/842,150, dated Jun. 18, 2014.
Leviton LED Magnetic Tube Retrofit Series datasheet, 1 page. from www.leviton com.
Restriction Requirement from U.S. Appl. No. 13/839,130, dated Jul. 28, 2014.
Office Action from U.S. Appl. No 13/839,130, dated Sep. 25, 2014.
International Search Report and Written Opinion from PCT Application No. PCT/US2013/021053. dated Apr. 17, 2013.
Notice to Submit a Response from Korean Patent Application No. 30-2011-0038115, dated Dec. 12, 2012.
Notice to Submit a Response from Korean Patent Application No. 30-2011-0038116. dated Dec. 12, 2012.
International Search Report and Written Opinion for PCT Application No. PCT/US2011/062396. dated Jul. 13, 2012.
International Search Report and Written Opinion for Patent Application No. PCT/US2011/001517. dated: Feb. 27, 2012.
U.S. Appl. No. 12/418,796, filed Apr. 6, 2009.
U.S. Appl. No. 13/429,080, filed Mar. 23, 2012.
U.S. Appl. No. 13/028,946, filed Feb. 16, 2011.
U.S. Appl. No. 13/306,589, filed Nov. 29, 2011.
US Publication No. US 2007/0115671, date: May 24, 2007 to Roberts et al.
US Publication No. US 2007/0115670, date: May 24, 2007 to Roberts et al.
US Publication No. US 2009/0323334, date: Dec. 31, 2009 to Roberts et al.
US Publication No. US 2009/0225543, date: Mar. 5, 2008 to Roberts et al.
U.S. Appl. No. 12/873,303, filed Aug. 31, 2010 to Edmond, et al.
U.S. Appl. No. 12/961,385, filed Dec. 6, 2010 to Pickard, et al.
Cree's XLamp XP-E LED's, data sheet, pp. 1-16.
Cree's XLamp XP-G LED's, data sheet, pp. 1-12.
Office Action from Japanese Design Patent Application No. 2011-18570.
Reason for Rejection from Japanese Design Patent Application No. 2011-18571.
Reason for Rejection from Japanese Design Patent Application No. 2011-18572.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
XLamp®C family from Cree®, Inc., Product Family Data Sheet, 15 pages.
XLamp®M family from Cree®, Inc., Product Family Data Sheet, 14 pages.
XLamp®X family from Cree®, Inc., Product Family Data Sheet, 17 pages.
Energy Star® Program Requirements for Solid State Lighting Luminaires, Eligibility Criteria—Version 1.1, final: Dec. 19, 2008.
Assist Recommends . . . LED Life for General Lighting: Definition of Life, vol. 1, Issue 1, Feb. 2005.
"IES Approved Method for Measuring Lumen Maintenance of LED light Sources", Sep. 22, 2008, ISBN No. 978-0-87995-227-3, (LM-80).
U.S. Appl. No. 13/649,052, filed Oct. 12, 2012, Lowes, et al.
U.S. Appl. No. 13/649,067, filed Oct. 10, 2010, Lowes, et al.
U.S. Appl. No. 13/207,204, filed Aug. 10, 2011, Athalye, et al.
U.S. Appl. No. 13/365,844.
U.S. Appl. No. 13/662,618, filed Oct. 29, 2012, Athalye, et al.
U.S. Appl. No. 13/462,388, filed May 2, 2012.
U.S. Appl. No. 13/842,150, filed Mar. 15, 2013, Dixon, et al.
U.S. Appl. No. 13/770,389, filed Feb. 19, 2013, Lowes, et al.
U.S. Appl. No. 13/782,820, filed Mar. 1, 2013, Dixon, et al.
Office Action from U.S. Appl. No. 13/834,605, dated Apr. 9, 2015.
Office Action from U.S. Appl. No. 13/840,812, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 13/829,558, dated Sep. 30, 2014.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Office Action from U.S. Appl. No. 13/672,592, dated Jan. 7, 2015.
Office Action from U.S. Appl. No. 13/842,150, dated Jan. 22, 2015.
Office Action from U.S. Appl. No. 13/829,558, dated Mar. 9, 2015.
Office Action from U.S. Appl. No. 13/958,462, dated Mar. 10, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 13/829,558, dated Sep. 11, 2015.
Office Action from U.S. Appl. No. 14/252,685, dated Oct. 1, 2015.
Office Action from U.S. Appl. No. 13/958,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/672,592, dated Nov. 23, 2015.
Office Action from U.S. Appl. No. 14/220,750, dated Dec. 14, 2015.
Office Action from U.S. Appl. No. 14/108,168; Dec. 24, 2015.
Office Action from U.S. Appl. No. 13/842,150; Dec. 30, 2015.
Office Action from U.S. Appl. No. 13/763,270; Jan. 12, 2016.
Office Action from U.S. Appl. No. 14/070,098; Feb. 5, 2016.
Office Action from U.S. Appl. No. 13/829,558; Feb. 19, 2016.
Office Action from U.S. Appl. No. 13/910,486; Mar. 1, 2016.
Office Action from U.S. Appl. No. 14/108,168; May 20, 2016.
Office Action from U.S. Appl. No. 14/252,685; May 20, 2016.
Office Action for U.S. Appl. No. 13/958,461; Jun. 17, 2016.
Office Action for U.S. Appl. No. 13/910,486; Jun. 23, 2016.
Office Action for U.S. Appl. No. 13/763,270; Jul. 15, 2016.

* cited by examiner

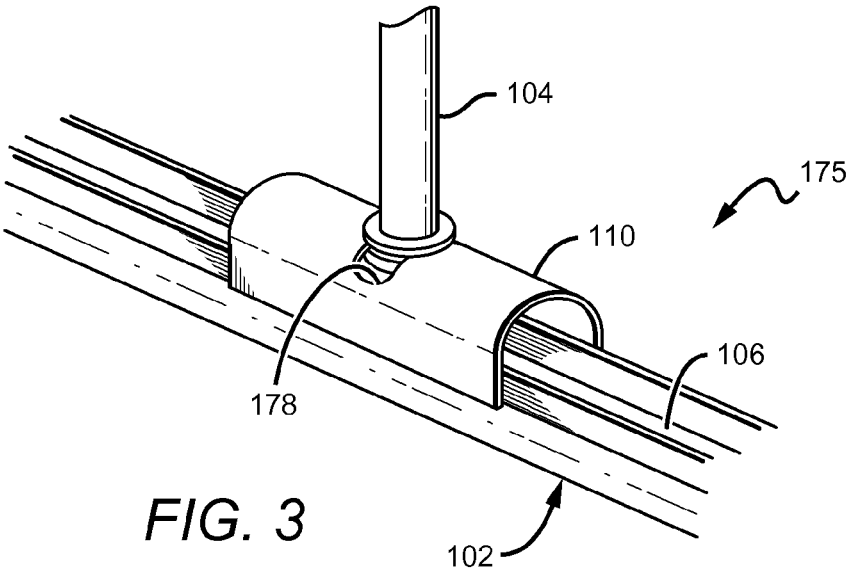
FIG. 3
FIG. 4
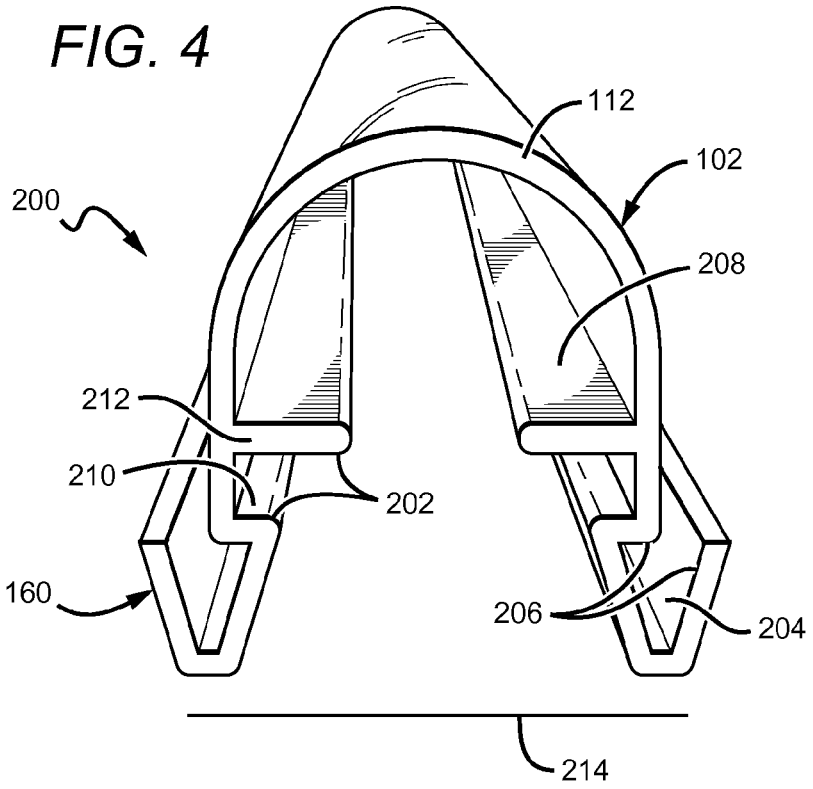

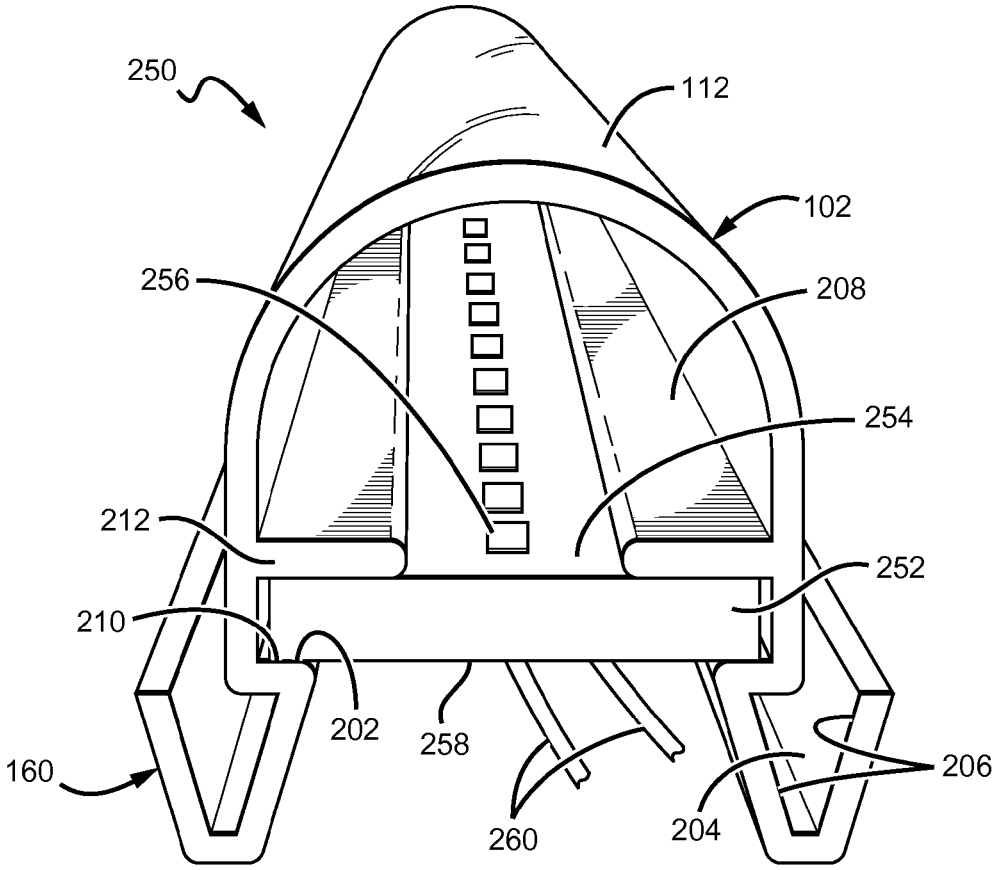
FIG. 5
FIG. 6
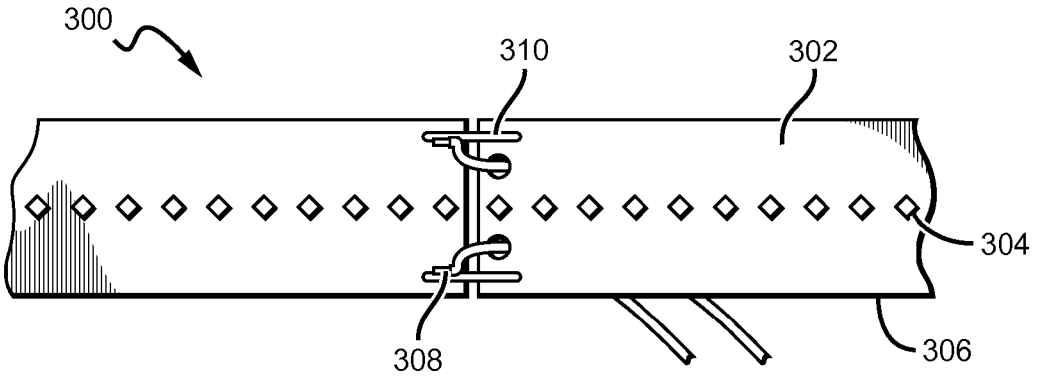

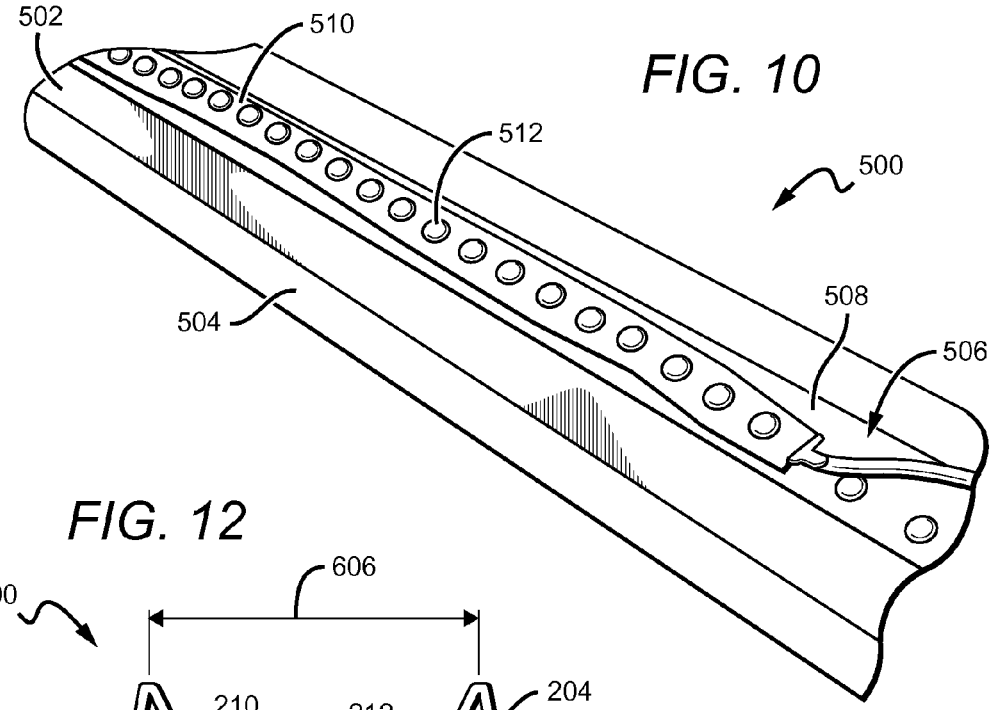
FIG. 10
FIG. 12
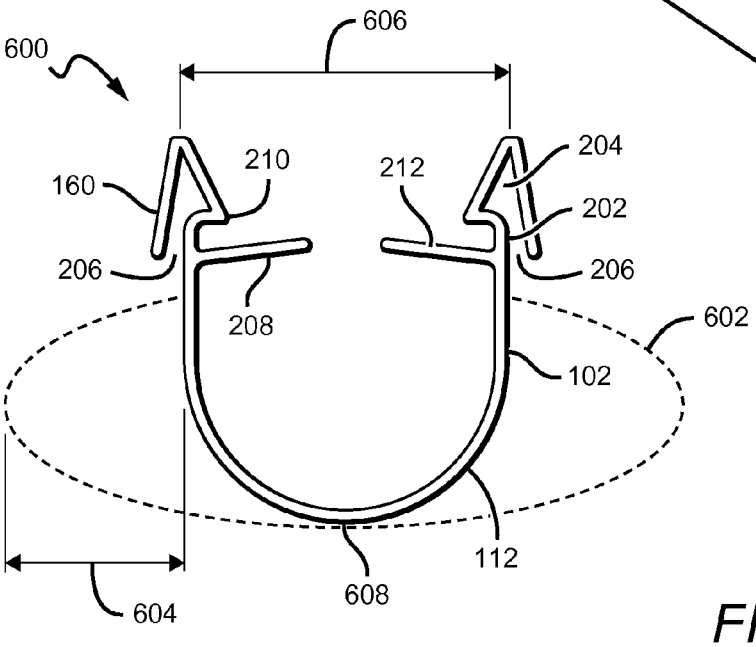
FIG. 13
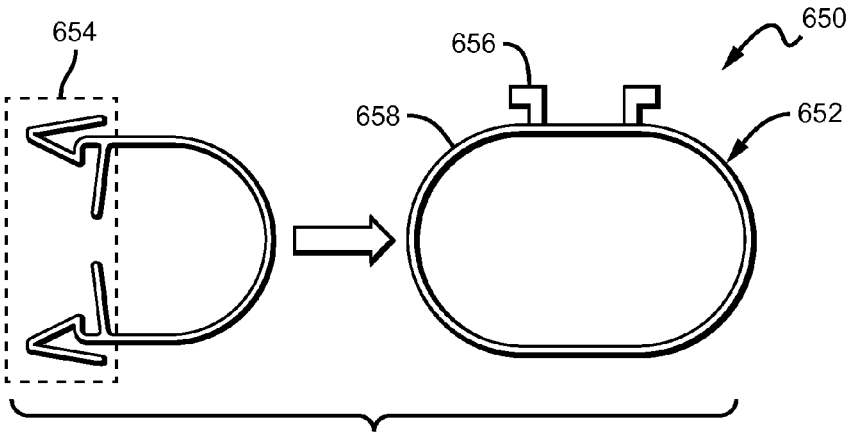

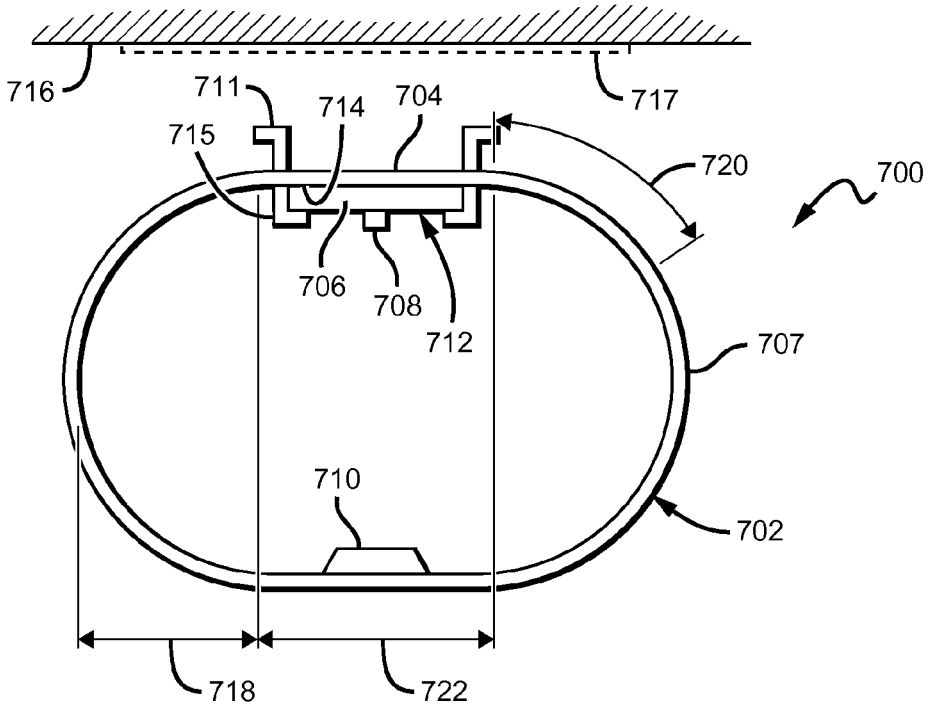
FIG. 14
FIG. 15
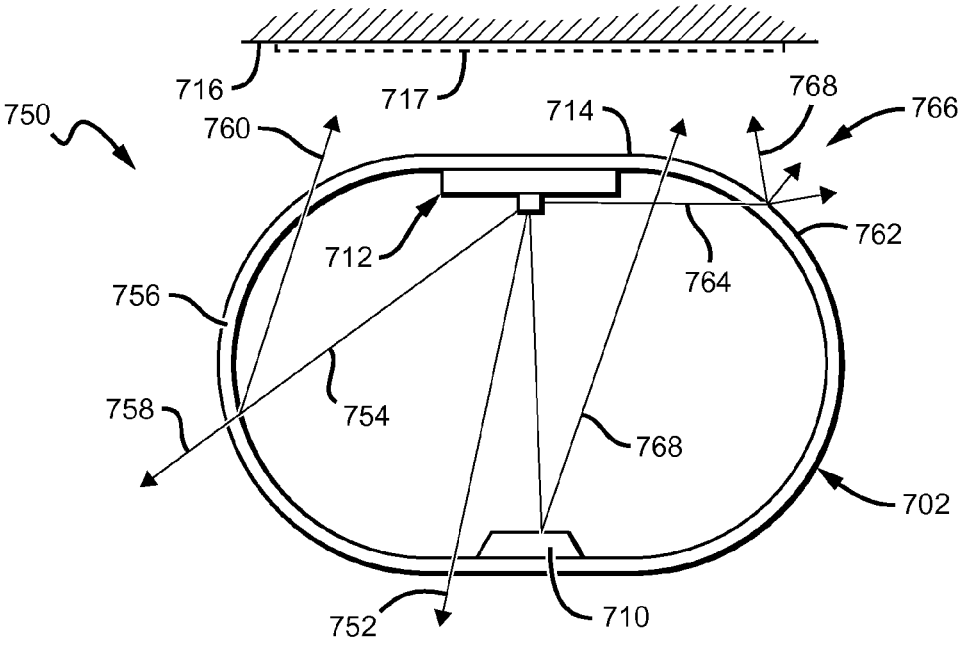

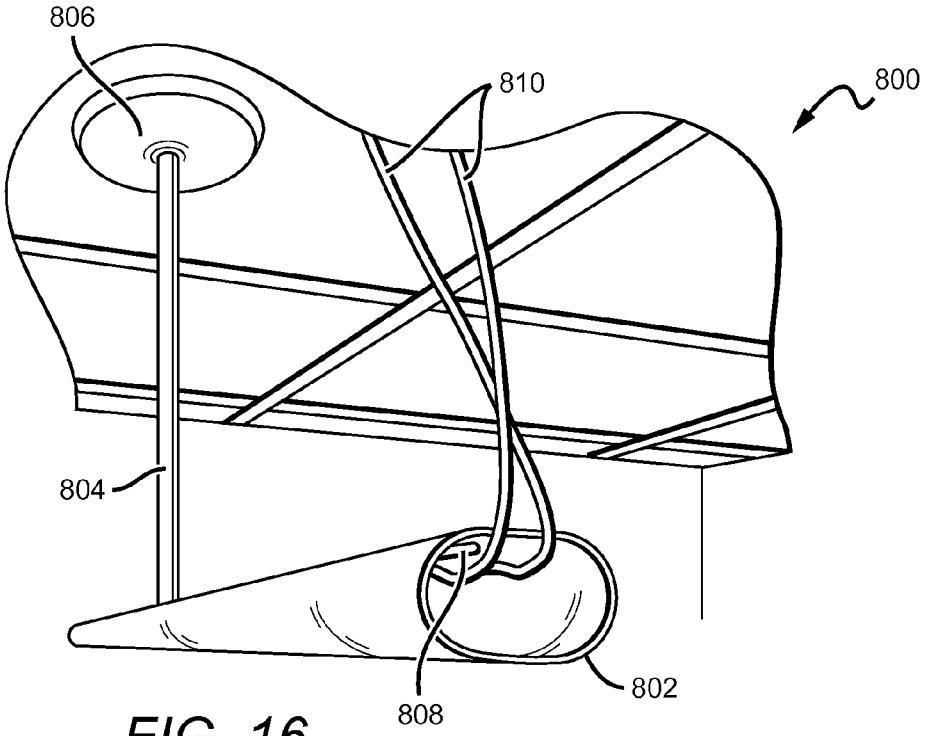
FIG. 16
FIG. 19
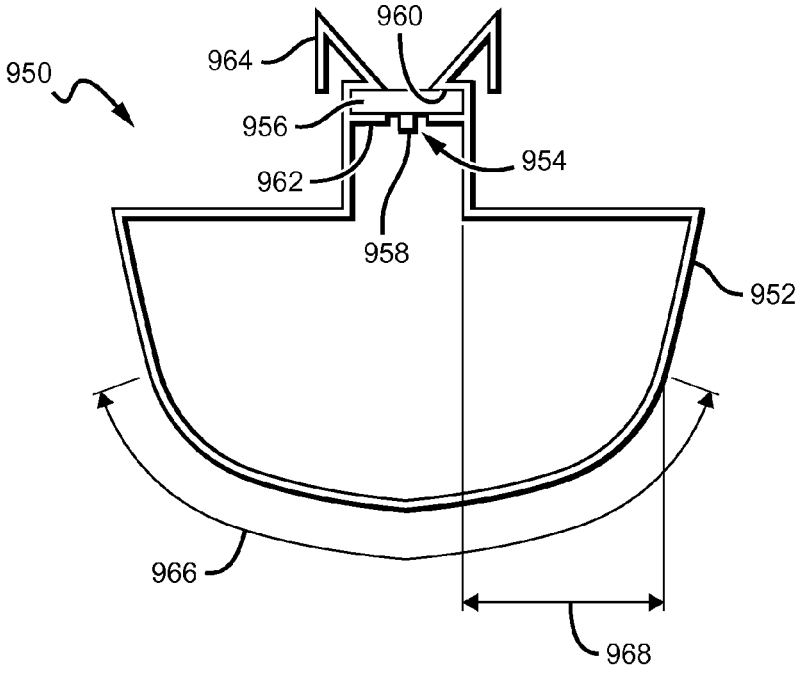

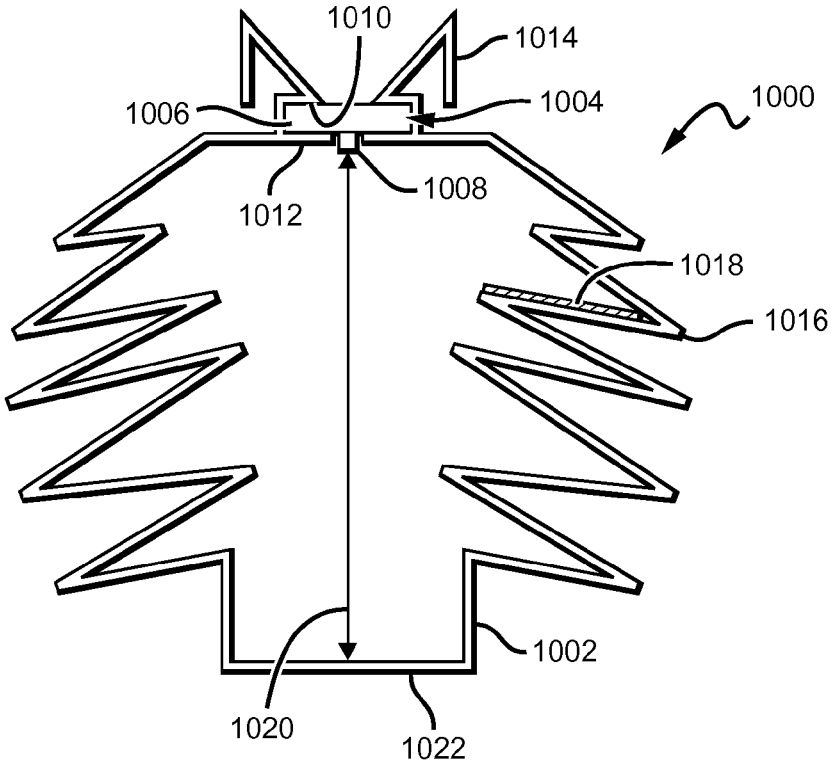
FIG. 20
FIG. 21
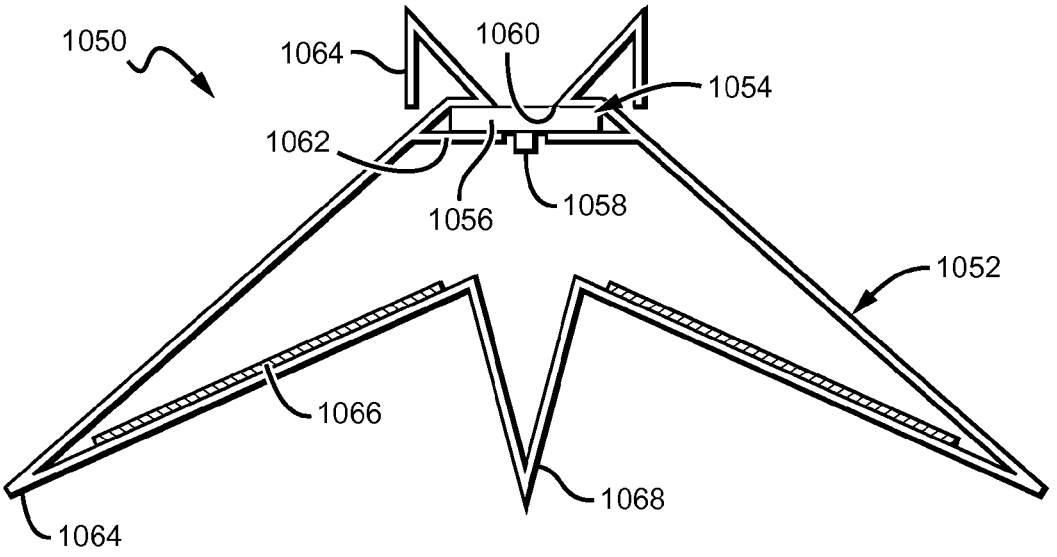

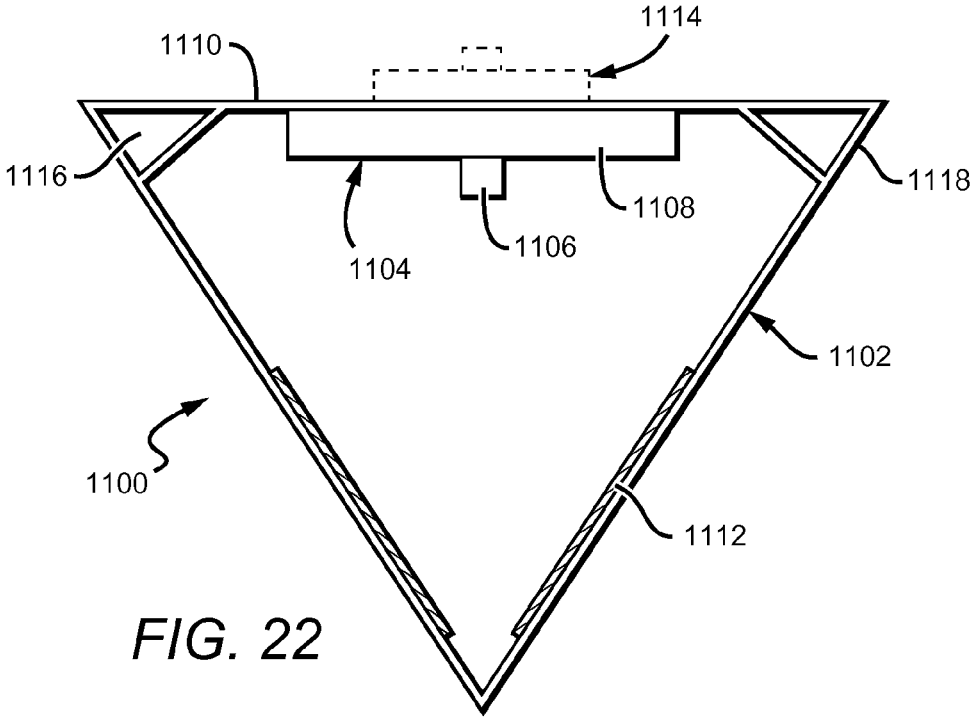
FIG. 22
FIG. 23
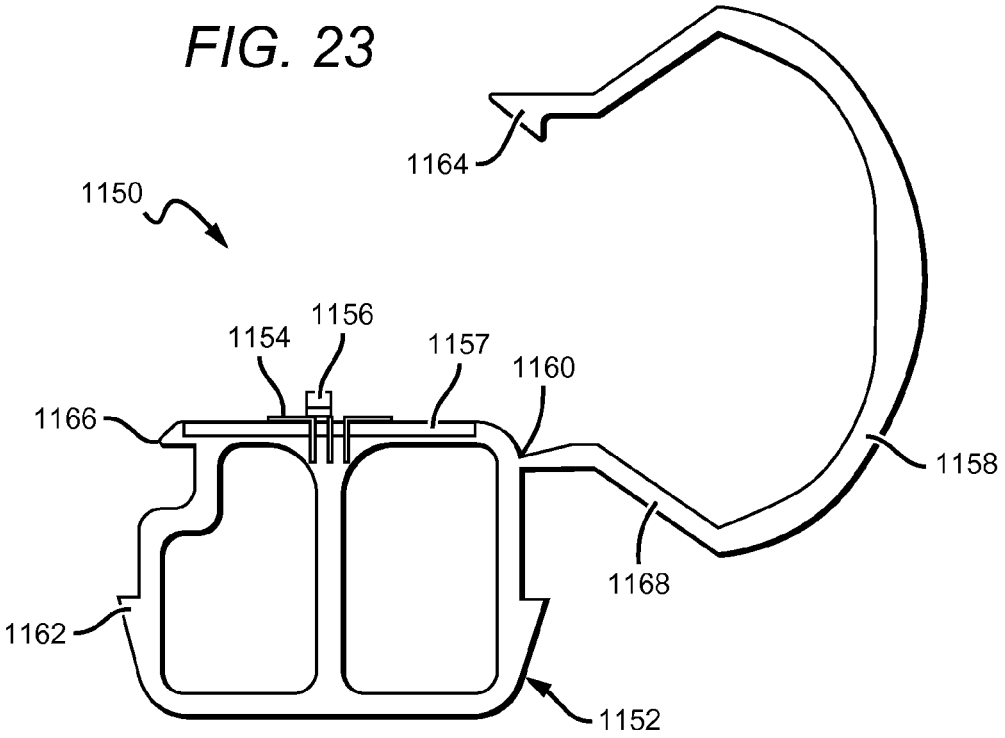

UPLIGHT WITH SUSPENDED FIXTURE

CROSS REFERENCE TO RELATED APPLICATIONS

This application is a continuation in part of, and claims the benefit of, U.S. patent application Ser. No. 13/840,812 to Mark Dixon et al., entitled Integrated Linear Light Fixture, filed on Mar. 15, 2013, which is a continuation application of, and claims the benefit of, U.S. patent application Ser. No. 13/782,820 to Mark Dixon et al., also entitled Integrated Linear Light Fixture, filled on Mar. 1, 2013, which is a continuation in part of, and claims the benefit of, U.S. patent application Ser. No. 13/672,592 to Mark Dixon, entitled Recessed Light Fixture Retrofit Kit, filed on Nov. 8, 2012. This application is also a continuation in part of, and claims the benefit of, U.S. patent application Ser. No. 13/842,150, to Mark Dixon, et al., entitled Suspended Linear Fixture, filed on Mar. 15, 2013, which is a continuation in part of, and claims the benefit of, U.S. patent application Ser. No. 13/782,820, to Mark Dixon, et al., entitled Integrated Linear Light Engine, filed on Mar. 1, 2013, which is a continuation in part of and claims the benefit of U.S. patent application Ser. No. 13/672,592 to Mark Dixon, entitled Recessed Light Fixture Retrofit Kit, filed on Nov. 8, 2012. All of these applications are hereby incorporated herein in their entirety by reference, including the drawings, charts, schematics, diagrams and related written description.

BACKGROUND OF THE INVENTION

1. Field of the Invention

Described herein are devices relating to lighting fixtures, such as suspended linear lighting fixtures, that are well suited for use with solid state lighting sources, such as light emitting diodes (LEDs).

2. Description of the Related Art

Lighting fixtures, such as Troffer-style lighting fixtures, are ubiquitous in commercial office and industrial spaces throughout the world, oftentimes being designed to have a spatially convenient and aesthetically pleasing linear appearance. To this end, many of these lighting fixtures house linear elongated fluorescent light bulbs that span the length of the troffer. These lighting fixtures can be mounted to or suspended from ceilings, and can be at least partially recessed into the ceiling, with the back side of the troffer protruding into the plenum area above the ceiling. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, troffers and other commercial lighting fixtures have been developed that utilize LEDs as their light source. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications, such as troffers, that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications, including commercial lighting fixtures. An increase in the adoption of LEDs in place of incandescent or fluorescent lighting would result in increased lighting efficiency and significant energy saving.

LEDs can be arranged in different ways in the above mentioned lighting fixtures, with some fixtures having LEDs incorporated into a linear lighting device and having a structure similar to a florescent tube. Many of these fixtures are suspended some distance from the ceiling, for example, by utilizing mechanical supports at either end of the fixture. This suspension arrangement allows the light to be positioned such that it illuminates more of a given room and is particularly useful in areas with higher ceilings.

One undesirable side effect of utilizing a suspended lighting fixture, due to the fixture's shadow and the lack of upward directed light ("uplight"), the ceiling and area directly above the suspended fixture does not receive sufficient lighting. This results in a dark area that obscures the view of ceiling and other structures above the suspended fixture, producing an obscuring "cave effect." This cave effect distorts the perceived relationship in space between the walls and various objects in the room, resulting in an observer not being able to determine the spatial perimeters of the room, for example, the distance from the floor to the ceiling. This distortion effect on the senses can be especially true in large rooms with high ceilings and results in a sensation that is disorienting and unpleasant.

SUMMARY OF THE INVENTION

The present invention is generally directed to lighting fixtures, such as suspended lighting fixtures, that comprise features allowing some emitted light to be directed in an upward direction, resulting in increased illumination of the surface upon which the light is mounted on. This increased illumination of the mounting surface improves illumination uniformity of a space and reduces disorienting sensory effects that can occur when a mounting surface is obscured by insufficient light.

In some embodiments, the lighting fixtures can comprise one or more lighting bodies, and can be suspended, such as by a suspension mechanism. These lighting bodies can be configured to receive one or more lighting elements, which can be many different lighting elements including light engines and LED based lighting elements. These fixtures can increase the amount of "uplight" produced by various structural features of the lighting fixtures including the shape, composition, and arrangement of the lens and/or body, and the arrangement of the lighting element.

One embodiment of a lighting fixture according to the present disclosure comprises an elongated body configured to receive at least one lighting element, which can be many different lighting elements as will be described in more detail further below, a suspension mechanism arranged to connect the body to a mounting surface, and a lens having at least one emission surface that is opposite to the mounting surface. This fixture is arranged to direct at least some light emitted by the lighting element toward said mounting surface. As will be discussed below, the fixture arrangement can direct the light toward the mounting surface in many ways, including utilizing various lighting element arrangements and lens and body arrangements. As will be discussed further below, a portion of the body, or its entirety, can function as the lens. Since the entirety of the body can function as a lens, it is understood that portions of this disclosure that refer to a lens can equally refer to the body.

Another embodiment of a lighting fixture according to the present disclosure comprises an elongated body, at least one lighting element mounted to a mounting surface of the body, which can be many different types of surfaces as will be described in more detail further below, and a lens arranged to control at least some light emitted by the lighting element such that the emitted light illuminates an area opposite the area upon which the lighting element is mounted within the body. Like the embodiment above, a portion of the body, or its entirety, can function as the lens.

Still another embodiment of a lighting fixture according to the present disclosure comprises an elongated body, a suspension mechanism arranged to connect the body to a mounting surface and at least one lighting element configured to direct at least some emitted light toward the mounting surface. As will be discussed in more detail further below, there are many different lighting element arrangements that can be utilized with this embodiment.

These and other further features and advantages of the invention would be apparent to those skilled in the art from the following detailed description, taking together with the accompanying drawings, wherein like numerals designate corresponding parts in the figures, in which:

BRIEF DESCRIPTION OF THE DRAWINGS

FIG. 3 is partial side perspective view of one embodiment of a lighting fixture according to the present disclosure;

FIG. 4 is a front perspective view of one embodiment of a base lighting fixture that can be utilized with the present disclosure;

FIG. 5 is a front perspective view of one embodiment of a base lighting fixture that can be utilized with the present disclosure;

FIG. 6 is a partial top perspective view of one embodiment a lighting element that can be utilized with the present disclosure;

FIG. 10 is a partial top perspective view of one embodiment a lighting fixture according to the present disclosure;

FIG. 12 is schematic representation of adjusting the lens shape of a base lighting fixture to achieve a lighting fixture body shape that can be utilized with the present disclosure;

FIG. 13 is another schematic representation of adjusting the lens shape of a base lighting fixture to achieve a lighting fixture body shape that can be utilized with the present disclosure;

FIG. 14 is a front sectional view of one embodiment of a lighting fixture according to the present disclosure;

FIG. 15 is a front sectional view of one embodiment of a lighting fixture according to the present disclosure displaying an uplight effect;

FIG. 16 is front perspective view of one embodiment of a lighting fixture according to the present disclosure;

FIG. 19 is a front sectional view of one embodiment of a lighting fixture according to the present disclosure;

FIG. 20 is a front sectional view of one embodiment of a lighting fixture according to the present disclosure;

FIG. 21 is a front sectional view of one embodiment of a lighting fixture according to the present disclosure;

FIG. 22 is a front sectional view of one embodiment of a lighting fixture according to the present disclosure;

FIG. 23 is a front sectional view of one embodiment of a light engine that can be utilized with features according to the present disclosure;

DETAILED DESCRIPTION OF THE INVENTION

Figure 1:
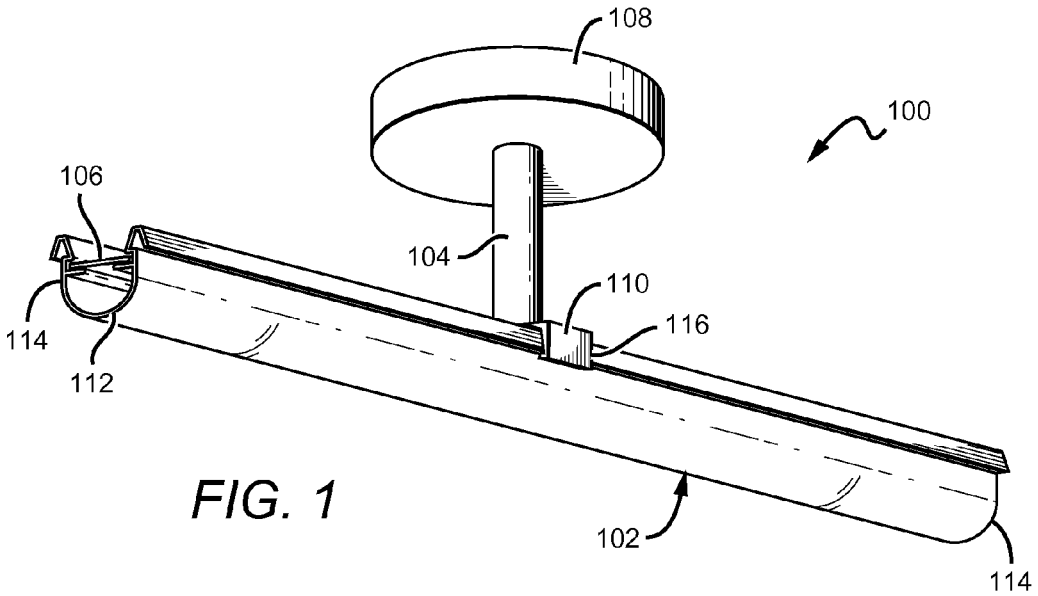
FIG. 1 is a side perspective view of one embodiment of a base lighting fixture that can be utilized with the present disclosure.

The present disclosure is directed to different embodiments of lighting fixtures that allow for increased uplight illumination. In some embodiments, devices according to the present disclosure comprise a fixture body, a lighting element and a lens. In some embodiments one or more portions of the fixture body can function as the lens. In some embodiments, the lens can be integrated into the fixture body. Some embodiments can also provide increased uplight by utilizing various lighting element arrangements, while some embodiments can also provide increased uplight through adjusting the arrangement of the lens and/or body of the lighting fixture.

In some embodiments, lighting fixtures according to the present disclosure can comprise a lighting elements, such as an LED array mounted on a printed circuit board ("PCB"). In conventional PCBs, the LEDs emit light in a primary direction, but not the direction opposite the surface of the PCB upon which the LEDs are mounted. In some embodiments, small openings or holes are made in areas of the PCB allowing some light emitted from the LEDs to pass through the PCB and emit in a direction opposite the surface of the PCB upon which the LEDs are mounted. This allows for some uplight and increases illumination in the direction of a surface the fixture is mounted on.

In some embodiments, lighting fixtures according to the present disclosure can comprise a lighting element comprising a dual-sided circuit board with an LED array bonded to each side. This lighting element can emit in opposite directions, for example, in a fixture suspended from the ceiling this lighting element can emit both toward the floor and the ceiling of a given room. This allows for even more uplight and increases illumination in the direction of a surface the fixture is mounted on.

In some embodiments, lighting fixtures can comprise a lighting element with a primary emission surface, such as a primary LED array mounted on a PCB and holes can be formed in the PCB such as in the embodiment described above. However, in these embodiments reverse-mounted LEDs can be mounted to the PCB on the same side as the primary LED array and can protrude through the holes in the PCB, resulting in a lighting element that can emit in opposite directions, much like the embodiment above. However, in these embodiments, a dual-sided PCB is not necessary, thus increasing manufacturing efficiency, manufacturing cost and device stability.

In some embodiments, lighting fixtures can comprise a lens arranged to direct light toward the mounting surface and/or in a direction opposite the mounting surface of a lighting element. These lenses can have an increased lateral profile, resulting in some light being reflected at angles in the desired direction. This increased lateral profile can be fabricated utilizing a large number of shapes including an oblong elliptical or circular shape and various shapes with "winged" or protruding portions. These lenses can further comprise various reflective, transparent, translucent, opaque or diffusive portions to further customize light output.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

As used herein, the term "lighting element" refers to any structure that can emit light in response to an electrical signal and includes LEDs and LED devices containing one or more LEDs arranged into an array or incorporated into a light engine.

As used herein, the terms "uplight," "upwardly directed light," and "light directed in an upward direction" can refer to light directed in an upward direction, as in cases wherein a lighting fixture is mounted to or suspended from a ceiling, or can refer to light directed toward the fixture mounting surface and light directed behind the portion of the body opposite an lighting element mounting surface.

As used herein in relation to physical (i.e. non-electrical) connections, the terms "connect," "connection" or "connected" refer to objects placed in contact with one another such that they are physically connected either temporarily or permanently. The terms "connection" or "connected" can be used to describe objects directly connected to each other (i.e. physically touching one another) or objects connected to one another with intervening structures and/or connections between them.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

As it would be beneficial to describe a base lighting fixture model that could be used as an example environment in which to employ various features according to the present disclosure, as well as to have a controlled environment in which to compare the efficiency of various embodiments in eliminating dark areas, such a base lighting fixture will now be described. Further examples of suspended lighting fixtures can be found in U.S. patent application Ser. No. 13/842,150, to Mark Dixon, et al., entitled Suspended Linear Fixture, which has been explicitly incorporated by reference above.

FIG. 1 is a side perspective view of one embodiment of a base lighting fixture 100 that can be utilized with the present disclosure. Lighting fixture 100 comprises a lighting element body or light engine 102, which can impart a linear or elongated shape to the fixture and can be arranged to receive at least one lighting element 106, and at least one suspension mechanism 104, which can fix body 102 spatially in place at least some distance away from a mounting surface, such as a ceiling, floor or wall. Lighting fixture 100 can further comprise a power supply cover 108 which can connect lighting fixture 100 to a mounting surface and conceal a power supply and/or power cord or other electrical connection elements. Suspension mechanism 104 can further comprise a connection element 110, which serves to connect body 102 to suspension mechanism 104 and can provide additional structural support for lighting fixture 100.

Body 102 can be made from any suitable material that can impart a rigid structure but at least a portion of body 102, which is configured to serve as a lens 112, is capable of facilitating the transmittance of light. Multiple portions or the entirety of body 102 can also serve as a lens. Body 102 can comprise a variety of materials, including but not limited to metals, plastics, acrylic, polyethylene, various other polymers and/or combinations thereof. In one embodiment, body 102 can be formed from polycarbonate (PC). Body 102 can be formed via a number of processes, including but not limited to extrusion and molding, such as injection molding. Body 102 can be extruded in multiple sections and subsequently formed together into a single section. Body 102 can also be extruded as a single piece of material.

Body 102 can be clear, transparent or translucent such that light emitted from light source 104 can easily pass through body 102. Body 102 can also be diffuse, and in different embodiments can be made diffuse by various means including but not limited to being formed from a diffuse material, being patterned or shaped to have diffuse portions, or by adding materials having diffusing properties, such as diffusing particles. It is understood that the shape, dimensions and orientation of body 102 depicted in the drawings are but some of many the shapes, dimensions and orientation body 102 can take or comprise. Body 102 can comprise a variety of shapes, dimensions and orientations for various purposes, for example, depending on the lighting requirements of various spaces where lighting fixture 100 could be employed. In some embodiments, body 102 has a linear or elongated shape with at least one distal end 114 (two shown) which is distal from the point of connection 116 of suspension mechanism 104 to body 102. Since electrical and mechanical connections can be provided by suspension mechanism 104, it may not be necessary to form such connections at or near the distal ends 114 of body 102, which is typically necessary in contemporary linear fixtures. Since such connections at the distal ends 114 of body 102 are not necessary in fixtures according to the present disclosure, more freedom in the design and installation of such fixtures is achieved. However, in some embodiments electrical and/or mechanical connections are provided at the distal ends of body 102. These distal connections can be provided in lieu of or in addition to the connections discussed above.

Suspension mechanism 104, power supply cover 108 and connection element 110, can be made of the same materials as body 102 or can be made of different materials. Because in many embodiments suspension mechanism 104, power supply cover 108 and connection element 110, typically do not need to facilitate the transmittance of light, these structures can be more readily made from opaque materials. In some embodiments these elements can comprise heat conductive materials, such as metals, to assist in radiating heat away from the lighting element 106 and dissipate it into the surrounding ambient. It is understood that these elements can also comprise many different other materials including but not limited to including but not limited to metals, plastics, acrylic, polyethylene, various other polymers and/or combinations thereof.

Figure 2:
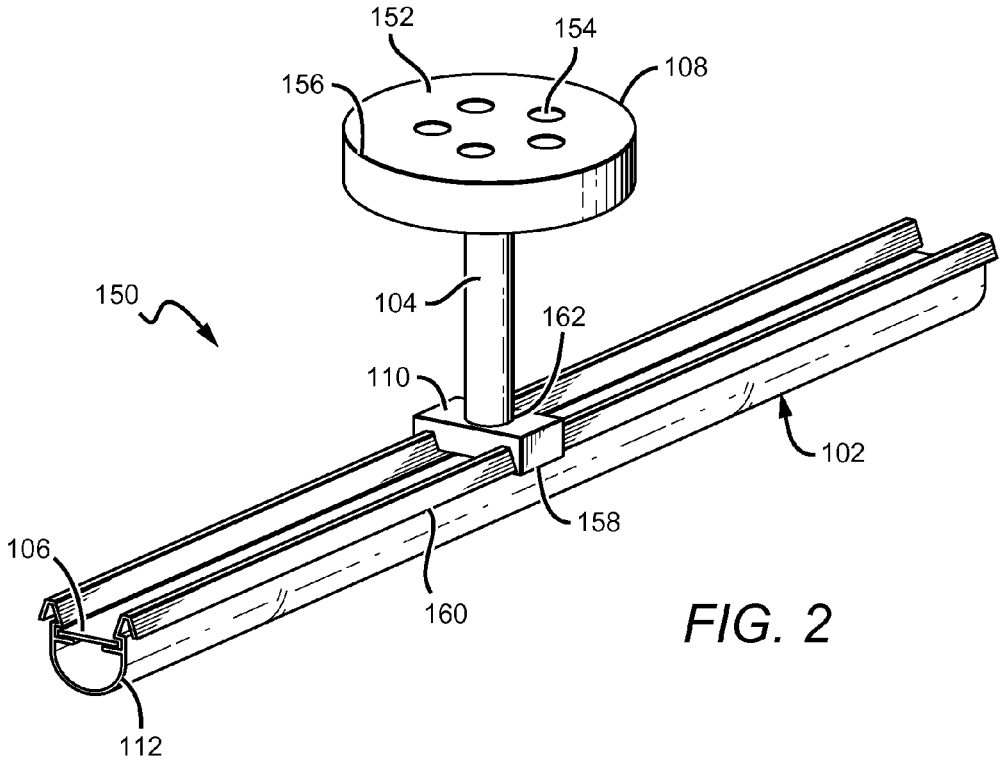
FIG. 2 is side perspective view of one embodiment of a base lighting fixture that can be utilized with the present disclosure.

FIG. 2 depicts another embodiment, similar to the embodiment of FIG. 1 above, wherein the corresponding disclosure above is incorporated into this embodiment such that like features share the same reference numbers. Lighting fixture 150 comprises body 102, suspension mechanism 104, power supply cover 108 and connection element 110. Like lighting fixture 100 in FIG. 1 above, lighting fixture 150 is also configured to receive at least one lighting element 106. FIG. 2 shows the top surface 152 of power supply cover 108. Top surface 152 can be configured to facilitate connection to a mounting surface using various means known in the art including but not limited to adhesives and mechanical connection such as screws, hooks and nails.

The top surface 152 of power supply cover 108 can further comprise one or more holes 154. Holes 154 allow outside access to any power supply and/or electrical components internal to power supply cover 108. Alternatively or in addition to the use of holes 154, some or all of the top surface of power supply cover 108 can be missing, providing outside access to internal components. In this latter case, the outer edge 156 of the top surface 152 of power supply cover 108 can be connected to a mounting surface using means known in the art as described above. In some embodiments, power cover 108 is connected to a mounting surface, such as a ceiling, and an internal power supply within power supply cover 108 is put into electrical communication with a junction box within the mounting surface. In other embodiments, electrical connections, for example provided by cords or wires, can be directly established from a lighting element to a junction box within the mounting surface.

Connection element 110 can provide permanent or temporary connection between body 102 and suspension mechanism 104. Connection element 110 can provide this connection in various ways, for example by providing a complimentary surface to another surface on body 102 and/or suspension mechanism on which to utilize an adhesive or mechanical connection element.

As mentioned above, the connection element 110 can be self-coupling or self-connecting to allow for the body 102 to be mounted in its operation location in the light fixture 150 without the need for mounting fixtures such as screws, bolts, brackets, clamps, etc., or the need for bonding materials such as glues. These self-connecting connection elements can also allow for the body 102 to be removable mounted in the fixture so that is can be removed from the fixture for repair or replacement. In some embodiment, the body 102 can be removed by hand from the fixture 100.

In some embodiments, connection element 110 comprises one or more connection element snap-fit structures 158 that allow the body to be snapped into place. The elements in the connection element 110 can be shaped or configured to interact or mate with one or more corresponding body snap-fit receiving structures 160. The snap-fit connection can be configured such that it is a strong and rigid connection that prevents substantial movement of body 102 should body 102 be physically disturbed or displaced. Alternatively, the snap-fit arrangement can allow for body 102 to be securely connected to suspension mechanism 104, but able to be displaced. For example, connection element 110 and body 102 can utilize a grooved arrangement of connection element snap-fit structures 158 and body snap-fit structures 160 to allow body 102 to slide in relation to connection element 110, while maintaining connection between the two structures. This would allow a user to adjust the point of connection of connection element 110 to body 102.

The snap-fit connection can be configured such that body 102 is securely connected to suspension mechanism 104 and will not become unconnected through the weight of body 102 or unintentional displacement of body 102, but can become unconnected due to intentionally applied force, for example manual operation force, applied directly to the snap fit connection. This arrangement allows for body 102 to be spatially re-adjusted in relation to suspension mechanism 104, providing more freedom of arrangement in designing lighting arrangements, especially in limited space.

Multiple portions of connection element 110 can be configured in different ways to allow for further control of the properties of emitted light. For example, the junction 162 where connection element 110 connects to suspension mechanism 104 there can be an elongated hole on the top surface of the connection element 110. This elongated hole portion 178 is best shown in FIG. 3, which depicts another lighting fixture 175, similar to the lighting fixtures 100 and 150 (in FIG. 1 and FIG. 2 respectively), wherein the corresponding disclosure above is incorporated into this embodiment such that like features share the same reference numbers. Lighting fixture 175 also comprises body 102, suspension mechanism 104, lighting element 106 and a connection element 110.

In conjunction with the embodiments according to the present disclosure, which provide increased uplight as will be discussed below, elongated hole portion 178 can allow emitted uplight to be directed through elongated hole portion 178 in additional directions such as upward and obliquely. Such elongated hole portions 178 can be utilized with various embodiments, including embodiments that allow for increased movement between the suspension mechanism 104 and the connection element 110. Such movement-enabling arrangements are discussed in U.S. patent application Ser. No. 13/842,150, to Mark Dixon, et al., entitled Suspended Linear Fixture, filed on Mar. 15, 2013, which has been expressly incorporated by reference herein. By changing the position of suspension mechanism 104 in relation to connection element 110, different areas of elongated hole portion 178 can be obscured or blocked, allowing uplight to be emitted through elongated hole portion 178 in various desired patterns and providing an additional level of control over emitted uplight.

In some embodiments, connection element 110 or body 102 can be configured to contain a power supply and/or other electrical and/or electronic components. This configuration can be utilized alternatively or in addition to embodiments wherein power supply cover 108 contains a power supply and/or other electrical components. Various electrical and/or electronic components can be arranged internally to body 102, power supply cover 108 and/or connection element 110. For example, in embodiments where an LED based lighting element 106 is to be utilized, current and voltage converters can be included in order to condition the input voltage and current to drive the appropriate design voltage and current of the LED circuit.

It is understood that while connection arrangements utilizing connection element 110 and body 102 are discussed above, other connection arrangements are also possible. For example, in embodiments wherein suspension mechanism 104 does not comprise connection element 110, body 102 can connect directly to suspension mechanism 104. In these embodiments, suspension mechanism 104 can comprise snap-fit structures or can be otherwise connect to body 102 as discussed above. Other connection mechanisms can also be used including but not limited to, snaps, screws, hooks, brackets, rivets, Velcro, or bonding agents such as glue.

Considering now the body portion of lighting fixtures according to the present disclosure, FIG. 4 depicts a front perspective view of one embodiment of lighting element body 200 according to the present disclosure. Lighting element body 200 is similar to lighting element body 102 described above, wherein the corresponding disclosure above is incorporated into this embodiment such that like features share the same reference numbers. Body 102 comprises lens 112, body snap-fit structures 160, and lighting element receiving structure 202. FIG. 4 is shown with the "lens-portion" in an upward facing orientation in contrast to FIGS. 1 and 2 above which depict the "lens-portion" in a downward facing orientation.

The entirety of body 102, or one or more dedicated surfaces, can serve as the lens portion 112. Lens 112 can protect a received lighting element and can diffuse, magnify, or otherwise alter light output. Lens 112 should be made from a material that facilitates the transmittance of light. Lens 112 can be made of the same material as the rest of body 102 or can be made from a different material and integrated into body 102, for example via a co-extrusion process. Lens 112 can be clear, transparent or translucent, or can comprise additional structures and materials for altering the color of emitted light, with some embodiments comprising wavelength altering materials such as phosphors. In other embodiments, lens 112 can comprise light scattering particles, and the lens 112 can be structured or patterned to increase light extraction. In other embodiments, light altering properties, such as diffusive properties, can be imparted to lens 112, for example, by physically roughening the surface of lens 112, for example, via a machining process.

As discussed above, body snap-fit structures 160 can be configured to interact or mate with corresponding structures on an connection element or on the suspension mechanism itself. FIG. 4 shows an embodiment wherein body snap-fit structures 160 comprise an accepting space 204 configured to receive a "hook-like" shape. A corresponding "hook-like" shape on an connection element can be placed within accepting space 204 where it will become locked in place by one or more gripping edges 206 (two shown).

Applying force, such as manual force, to gripping edges 206 can allow a user to remove a connected connection element or suspension mechanism from body 102 to allow for efficient cleaning and maintenance of lighting fixture 200. Furthermore, a user could then reconnect the connection element or suspension mechanism to another portion of body 102 to change the appearance of lighting fixture 200 or to accommodate for limited space. This allows for an adjustable mechanical suspension support connection between the connection element/suspension mechanism and body 102.

FIG. 4 further depicts lighting element receiving structures 202, which are arranged to receive at least one lighting element. Lighting element receiving structures 202 can comprise a variety of shapes and configurations that allow or facilitate the receiving and incorporation of a lighting element into lighting fixture 200. Various shapes and structures can be utilized as lighting element receiving structures 202 and can be integrated into the body as shown or be separately connected to the body. Example lighting element receiving structures 202 include wedge, fins or grooved structures. In the embodiment shown in FIG. 4, lighting element receiving structures 202 have a similar structure to gripping edges 206, and can likewise be manually adjusted to remove a secured structure, in this case, a lighting element.

Lighting element receiving structures 202 can comprise a portion that serves as a lighting element mount surface 210. Lighting element mount surface 210 can be utilized with or without securing structures 212 which help to secure a lighting element in place. When not utilizing securing structures 212, when a lighting element is mounted to lighting element mount 210, the lighting element can be mounted by various means known in the art, including but not limited to soldering, bonding agents, adhesives and pressure or temperature bonding. The lighting element can also be mounted onto the surface by co-formation during an extrusion process, with certain components, such as LEDs, added during or after the extrusion process.

Typically, in embodiments utilizing lighting elements that are LEDs bonded to a PCB, the LEDs emit light primarily in the direction toward lens portion 112, as well as laterally, with little to no light the direction opposite lighting element mounting surface 210, represented by a planar line 214. This is because as the LED emits light in angles in excess of 90°, any emitted light is blocked and/or absorbed by additional structures such as LED mounting substrates, the PCB and the lighting element mounting surface 210 itself.

One or more portions of lighting element receiving structures 202 can be configured to be reflective surfaces 208. By forming reflective surfaces 208, the light extraction efficiency of lighting fixture 200 can be increased. Reflective surfaces 208 can be made reflective in various ways, including but not limited to treating them with a reflective film or chemical coating, by plating them with a reflective material or by selecting a reflective material for their composition. In some embodiments, reflective surfaces 208 are made of a material that is reflective white.

In some embodiments, the housing has an integrated transmissive portion and a reflective portion, with the transmissive portion and reflective portions formed together as one piece during manufacturing. In some embodiments, the upper portion or lens portion 112 can comprise the transmissive portion and can be transmissive of the light emitted from the lighting element. The lower portion can comprise the reflective portion and can be reflective to the light from the lighting element. In the embodiment shown, the transmissive portion begins at the portion that is above the reflective surfaces 208, while the reflective surfaces 208 and anything below comprise a reflective material.

The transmissive portion can comprise any of the materials described herein and can be formed integral to the reflective portion by various processes such as co-extrusion or injection molding. The reflective portion can be formed of any materials described herein such as plastics, polymers and PC, with some of these materials being white. In other embodiments surfaces of the reflective portion can be coated with, or comprise, other reflective materials such as specular reflective or diffusing reflective materials. Forming integral lens and body portions allows for quick and inexpensive manufacturing of the body 102, and results in a robust and rigid housing structure. It is understood that other features of the light engine can be formed integral to the light engine housing through the co-extrusion process.

In considering the arrangement of the light fixture body after it has received a lighting element, FIG. 5 shows a front perspective view of one embodiment of a lighting fixture 250, similar to lighting fixture 200 above, wherein the corresponding disclosure above is incorporated into this embodiment such that like features share the same reference numbers. Like FIG. 4 above, FIG. 5 is shown with the "lens-end" in an upward position in contrast to FIGS. 1 and 2 above which depict the "lens-end" in a downward position. Lighting fixture 250 comprises body 102, which comprises lens 112, body snap-fit structures 160, lighting element receiving structure 202, accepting space 204, gripping edges 206 and reflective surfaces 208.

Lighting fixture 250 is arranged to accept lighting element 252. Lighting element 252 comprises a body 254, one or more LEDs 256, a PCB (on the opposite surface of body 254) 258 and electrical connections 260. FIG. 5 demonstrates the spatial arrangement of a lighting element 252 with the fixture body 102. Lighting element 252 is received by body 102 and secured in place by lighting element receiving structure 202. LEDs 256 face toward lens portion 112, with the PCB 258 facing the opposite direction (toward the end of body 102 that will be facing a connection element and/or suspension mechanism) and being in electrical contact with electrical connections 260.

Many different lighting elements can be utilized with lighting fixtures incorporating features of the present invention. In some embodiments, LED arrays or LED-based light engines can be used. For example, FIG. 6 is a partial top perspective view of an example lighting element that can be utilized with fixtures according to the present disclosure. FIG. 6 depicts a linear lighting element 300 comprising a reflective body 302, one or more LEDs 304, a printed circuit board ("PCB") 306 (on the opposite surface of body 302) and electrical connections 308. Body 302 can be made from a similar material to fixture body 102 discussed above, or made from another material know in the art that is suitable for mounting a plurality or array of LEDs. Multiple instances of lighting element 300 can be connected together by various means including chemical adhesives, soldering or mechanical connection structures such as connection clips 310. Electrical connections 308 can connect directly to the PCB 306.

Many different LEDs 304 can be utilized with lighting elements according to the present disclosure. For example, LEDs 304 can comprise highly efficient LED packages that are capable of operating at lower drive signals than many conventionally used LEDs. Since the current needed to drive such highly efficient LEDs can be lower, the power in each LED can also be lower. Multiple LEDs can be used to achieve the same output as fewer LEDs with a higher current. By using more LEDs, the necessary heat dissipation area can be smaller. Examples of such highly efficient LEDs are described in detail in U.S. patent application Ser. Nos. 13/649,052, 13/649,067 and 13/770,389, all of which are assigned to Cree, Inc., which are hereby incorporated herein in their entirety by reference, including the drawings, charts, schematics, diagrams and related written description.

One way in which such highly efficient LEDs can operate at lower drive signals than convention LEDs is that the highly efficient LED packages have a greater LED area per package footprint, which can allow for higher packing density. In many applications, this allows for driving the same area of LED packages with a lower drive signal to achieve the same emission intensity. This can result in greater emission efficiency. In other embodiments, the same drive current can be used, and the LED packages that can be utilized with the present invention can be used to generate higher emission intensity. These embodiments provide the flexibility of providing LED package emission with high luminous flux, or with lower luminous flux at greater efficiency.

Figure 7:
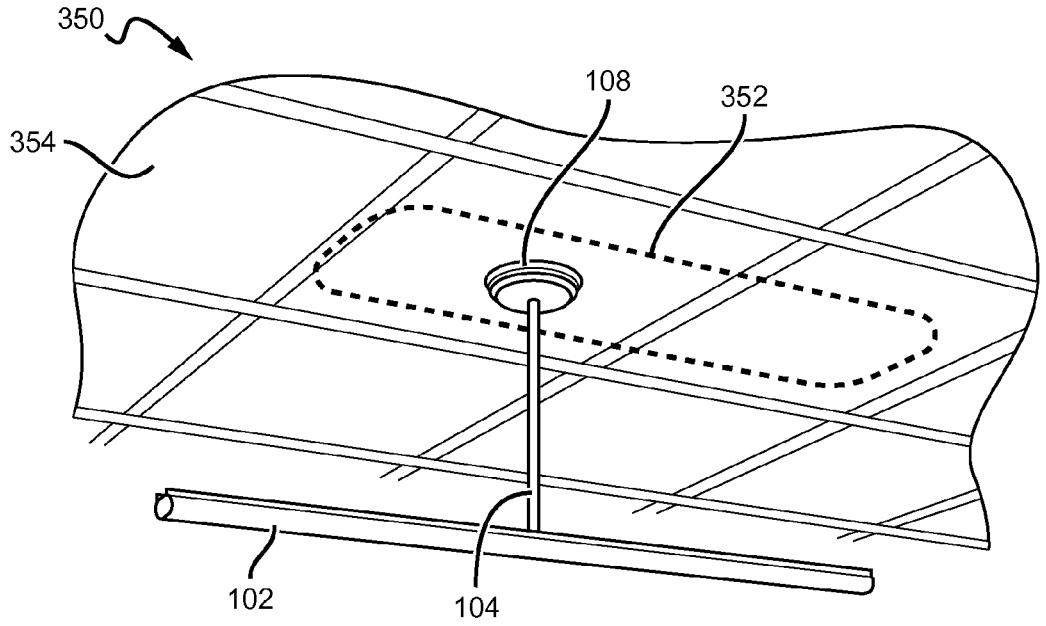
FIG. 7 is a side perspective view of a base lighting fixture that can be utilized with the present disclosure during operation.

Referring now to FIG. 7, which shows a lighting fixture 350, similar to the lighting fixtures depicted in FIGS. 1-5 above, wherein the corresponding disclosure above is incorporated into this embodiment such that like features share the same reference numbers. Lighting fixture 350 comprises body 102, suspension mechanism 104, and power supply cover 108. FIG. 7 shows lighting fixture 350 during operation. In the specific embodiment shown, 120 LEDs were used on a 44"×1" PCB as the lighting element. The body was made of coextruded polycarbonate (Sabic 9616/LUX 1619) the system utilized a 22 Watt power supply.

As shown in FIG. 7, there is a shadowed area 352 of insufficient light on the light fixture mounting surface 354. This shadowed area 352 can produce a "cave effect" which can distort the perceived relationship in space between the walls and various objects in the room. While in some cases this disorienting effect can be merely unpleasant, it can also be detrimental to individuals, for example, being detrimental to the performance of athletes in a gymnasium with shadowed high ceilings or to individuals involved in construction projects. In addition to the disorienting effect, the shadowed area 352 results in less lighting efficiency and less illumination in a room.

Figure 8:
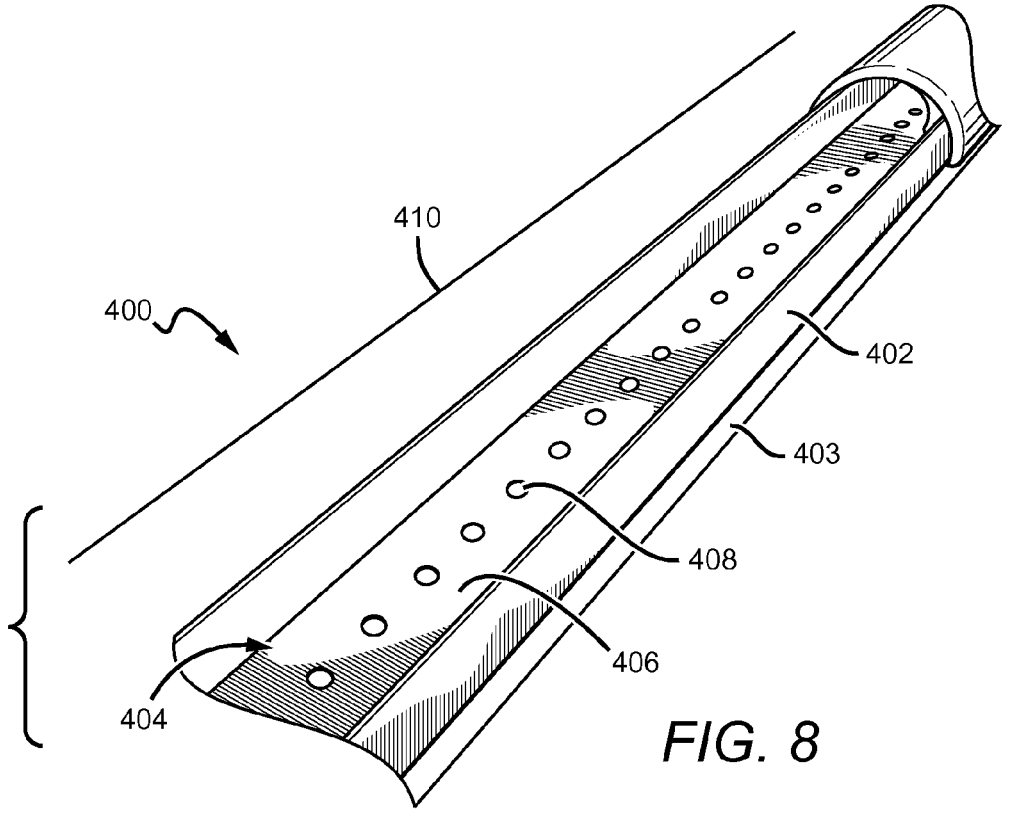
FIG. 8 is a partial top perspective view of one embodiment a lighting fixture according to the present disclosure.

Additional embodiments of lighting fixtures according to the present disclosure will now be addressed, applying various features to the base lighting fixture described in detail above. FIG. 8 shows a partial top perspective view of one embodiment a lighting fixture 400 according to the present disclosure. Lighting fixture 400 comprises a body 402, similar to body 102 above, lens portion 403 of body 402, similar to lens portion 112 above, and a lighting element 404, similar to lighting element 300 above. Lighting element 404 comprises a PCB 406, as well as ZED based lighting elements (not shown; mounted on the side opposite the exposed area of the PCB 406 facing). Unlike the embodiments discussed above, one or more holes 408 are formed in the PCB 406. These holes allow for some light emitted by lighting elements connected to the opposite side of the PCB (not shown) to be emitted in a direction opposite their lighting element mounting surfaces, represented by planar line 410. These holes can be formed in any acceptable location of the PCB, for example, a location that will not excessively interfere with the electrical operation of lighting fixture 400.

These holes 408 can be created utilizing various methods known in the art, including, but not limited to, machining (such as grinding, etching or drilling), chemical etching and laser etching. While the holes shown are depicted as being round and in a straight line, it is understood that the holes can comprise a number of different shapes and orientations and such different shapes and orientations can be selected for various properties, such as their effect on light emission angle or profile. In the embodiment depicted in FIG. 8, one-hundred 4 millimeter holes were added to the PCB 406, resulting in 1256 square millimeters of space for allowing light to escape in an upward direction.

Figure 9:
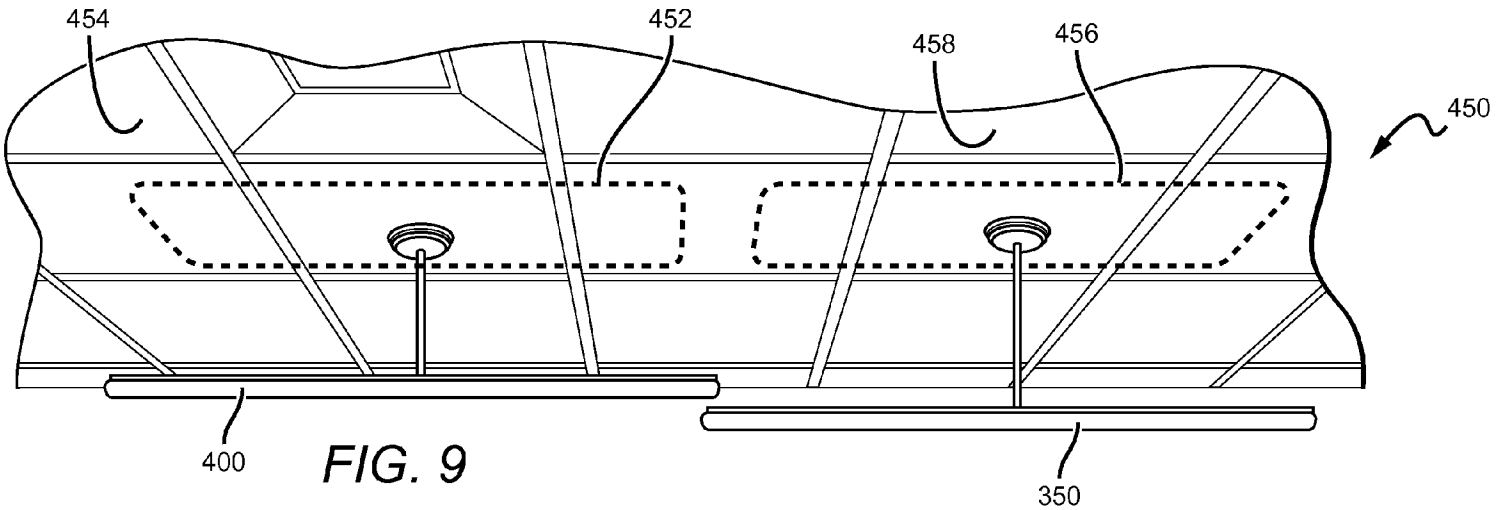
FIG. 9 is a side perspective view comparing a base lighting fixture that can be utilized with the present disclosure and the lighting fixture of FIG. 7 during operation.

The formation of holes 408 in the PCB 406 improves uplight illumination. FIG. 9 shows a side perspective view of a comparison 450 comparing the base lighting fixture 350 of FIG. 7, with the lighting fixture 400 of FIG. 8, which incorporates the holes formed in the PCB 406. As can be seen in FIG. 9, there is better observable illumination represented by a less dark shadowed area 452 on the fixture mounting surface 454, when compared to shadowed area 456 on lighting fixture mounting surface 458.

This improvement to illuminance due to the incorporation of the holes in the PCB is measurable. The illuminance of the base lighting fixture 350 was 55 lux, 54 lux, 59 lux, 54 lux and 50 lux over the left, center left, center, center right and right viewing angles respectively. The illuminance of the lighting fixture 400, incorporating PCB holes, was 89 lux, 95 lux, 98 lux, 90 lux and 75 lux over the left, center left, center, center right and right viewing angles respectively.

Another way of improving uplight is to utilize LEDs on both surfaces of the lighting element. FIG. 10 shows a partial top perspective view of one embodiment a lighting fixture 500 during operation. Lighting fixture 500 comprises a body 502, similar to body 102 above, lens portion 504 of body 502, similar to lens portion 112 above, and a lighting element 506, similar to lighting element 300 above. Lighting element 506 comprises a PCB 508, as well as LED based lighting elements (not shown; mounted on the side opposite the exposed area of the PCB 508 facing).

Unlike the embodiments discussed above, lighting fixture 500 further comprises an LED power strip 510 and LEDs 512 mounted on power strip 510. These LEDs 512 are facing the opposite direction of the mounting surface of the LEDs facing the lens, emitting more light in the direction of the fixture mounting surface. In the embodiment depicted in FIG. 10, a strip of mid-power PLCC2 LEDs were added to the top of the fixture for uplight. However, it is understood that many different LEDs can be utilized with embodiments according to the present disclosure, including the LEDs listed above and the LEDs described in the applications incorporated by reference herein.

The power strip 510 comprises a surface separate from the PCB 508 on which one or more LEDs are mounted. Power strip 510 comprises structures for providing an electrical connection to the mounted LEDs 512, for example, a separate PCB from PCB 508. Alternatively or in addition to a PCB, power strip 510 can comprise other conductive materials for providing electrical connection to the LEDs, for example, wire or foil (such as copper wire or copper foil), conductive rails, magnet wire, non-conductive materials selectively coated with conductive materials, flattened braided wire and flex circuits on polyamide film.

The structures utilized by power strip 510 to provide electrical connections to LEDs 512 can be utilized alone or in conjunction with conductive or nonconductive body elements that can impart power strip 510 with a desired shape, orientation or structural support. Power strip 510 can be mounted to various surfaces of the fixture 500, or the back surface of PCB 508, such that the mounted LEDs 512 provide uplight. Power strip 510 can be mounted by various mounting means know in the art such as using adhesives or bonding. Power strip 510 can also be integrated into body 502 via various means such as extrusion and snap fit structures or can simply be placed on a surface of the lighting fixture 500 that would allow LEDs 512 to provide uplight.

Figure 11:
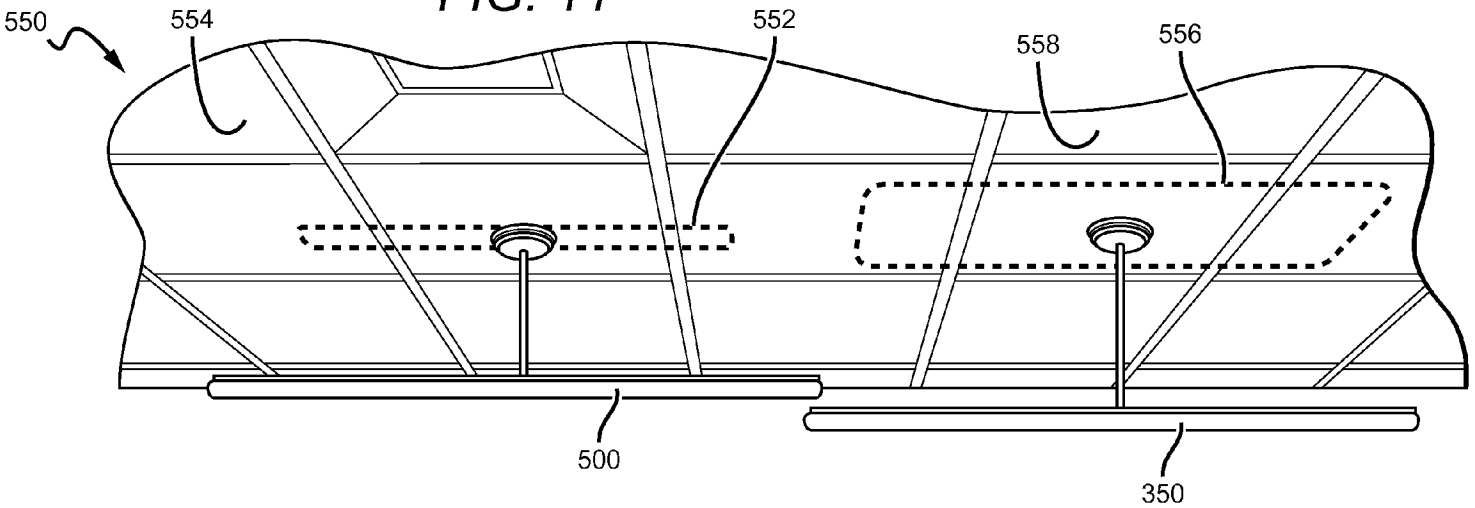
FIG. 11 is a side perspective view comparing a base lighting fixture that can be utilized with the present disclosure and the lighting fixture of FIG. 9 during operation.

The additional LEDs added opposite the lighting element mounting surface greatly improve uplight illumination. FIG. 11 shows a side perspective view of a comparison 550 comparing the base lighting fixture 350 of FIG. 7, with the lighting fixture 500 of FIG. 10, which incorporates the additional LEDs added to the top surface of the fixture 500 opposite the lighting element mounting surface. As can be seen in FIG. 11, there is significant improvement in uplight illumination represented by the relatively small dark shadowed area 552 on the fixture mounting surface 554, which corresponds to lighting fixture 500, when compare to shadowed area 556 on lighting fixture mounting surface 558, corresponding to lighting fixture 350.

As in the comparison 450 above, the illuminance of the base lighting fixture 350 was 54 lux and 50 lux over the center right and right viewing angles respectively. The illuminance of the lighting fixture 500, incorporating the power strip and uplight LEDs, was 102 lux and 85 lux, over the center right and right viewing angles respectively when current was adjusted to be the same as the current applied to the lighting fixture 400 above, which incorporated the PCB holes. Since the currents were adjusted to be the same, these values demonstrate a comparison in illuminance output between the PCB holes and uplight LED embodiments. When the current was adjusted to meet the condition of a uniform blend of light, the illuminance of lighting fixture 500 increased to 450 lux and 375 lux over the center right and right viewing angles respectively.

A lighting element can be arranged in a number of different ways, other than using a separate power strip of LEDs, in order to increase uplight illumination. For example, the PCB that is utilized can be made thinner, reducing the obstruction of emitted uplight. Additionally, a single dual-sided PCB board can be utilized and LEDs can be bonded on both sides of the PCB. This results in LEDs emitting in directions both toward the lens and toward the fixture mounting surface.

Another example of a way in with a lighting element can be arranged to improve uplight illumination is to utilize reverse mount LEDs. Reverse mount LEDs are generally known in the art and can be mounted to a PCB such that the primary emission surface of the LED faces toward the PCB. By making holes in the PCB as above, reverse mount LEDs can be mounted on the PCB on the same side as the typical LEDs. The reverse mount LEDs can be arranged such that the typical LEDs emit toward the lens portion of the lighting fixture and the reverse mount LEDs protrude through the holes in the PCB and emit in the opposite direction toward the fixture mounting surface, thus increasing uplight.

One advantage of using reverse mount LEDs over a dual-sided PCB or a power strip arrangement is that there are fewer conductive elements that can malfunction and the features are more easily integrated and bonded to one another. This results in a sturdier device structure. Additionally, by not having to utilize additional components (like a power strip of an additional side of PCB) manufacturing efficiency improves and manufacturing costs decrease.

In addition to utilizing various lighting element arrangements to increase uplight in fixtures according the present disclosure, different lens arrangements can be utilized to increase uplight. Two major ways in which the lens arrangement improves uplight emission, when compared to standard lens arrangements, include increasing the lateral profile width of the body and providing transparent or translucent lens portions in the upward-facing portions of body. Increasing the lateral profile width allows for more surface area of the lens to interact with rays of emitted light at a distance further out in a lateral direction. This increases the chance of rays of light being reflected or refracted in a direction that will illuminate the surface opposite the lighting element mounting surface. Providing a translucent or transparent lens portion in the upward facing portions of the body allows for additional light to pass through such portions and illuminate the surface opposite the lighting element mounting surface. These and other lens and body arrangements for increasing uplight emission are discussed in more detail further below.

FIG. 12 shows a schematic representation of a lighting fixture 600, similar to lighting fixture 200 above in FIG. 7, wherein the corresponding disclosure above is incorporated into this embodiment such that like features share the same reference numbers. Lighting fixture 600 comprises body 102, which comprises lens 112, body snap-fit structures 160, lighting element receiving structure 202, accepting space 204, gripping edges 206, reflective surfaces 208, lighting element mounting surface 210, and securing structures 212. In this embodiment, the entire portion of body 102 below securing structures 212 comprises lens 112.

In order to increase uplight through variation in lens arrangement, the lateral profile of the lens can be increased, for example to desired parameters 602. Desired perimeters 602 can be any increase in the lateral profile 604 of the fixture lens (or body serving as a lens) that promotes additional interaction with emitted light that controls or directs the emitted light in an upward direction. In one embodiment, the increase in the lateral profile of the device 604 is greater than the width of the lighting element mounting surface 606. In other embodiments, the increase in the lateral profile of the device 604 is substantially greater than the width of the lighting element mounting surface 606. The interaction of emitted light with the lateral sides of the device will be discussed further below.

There are many ways to achieve this lateral profile increase, one of the more efficient ways being to simply extrude the body 102 such that the entirety or a portion of body 102 comprises lens 112 and comprises a shape having a desirable lateral profile, such as when body 102 comprises an oblong or elliptical shape (as will be shown in FIG. 14 below). Another method is to co-extrude an additional lens portion having a desired lateral profile, for example co-extruding a lens portion having the same shape and configuration as desired parameters 602 along with body 102.

One example of an arrangement discussed above would be co-extruding the body and an additional structure so that the two structures are organized such that one structure is within the other structure (e.g. a "tube within a tube" structure wherein the body 102 is within the additional lens portion or vice-versa). In considering the embodiment depicted in FIG. 12, such an outer structure could have the dimensions and arrangement of desired perimeters 602 and have at least one desired property, for example being diffusive. The body 102 or a portion of body 102, for example, bottom portion 608, could have a different desired characteristic, for example, it can be transparent or translucent. This arrangement, with a transparent or translucent bottom portion 608 and with diffusive expanded lateral sides, allows for rays of light striking bottom portion 608 to pass thorough and illuminate in a downward direction and rays of light striking the expanded lateral sides of desired perimeters 602 to be refracted and illuminate in an upward direction. It is understood that various other arrangements utilizing two distinct co-extruded structures have the same or different characteristics can be utilized with the present invention. In addition to extrusion, various lens portions can be fabricated separately and connected to body 102 through snap-fit structures as above or via connection methods known in the art such as adhesives.

Another schematic representation 650 of adjusting the lens shape of the base lighting fixture to achieve a desirable lateral profile is shown in FIG. 13. In this schematic representation 650, an oblong or elliptical lighting fixture 652 is produced, for example, via an extrusion process. In the embodiment shown, lighting fixture 652 is produced by extruding a structure similar to lighting fixture 600 above, and utilizing additional lens material instead of the opaque or reflective portions 654. Connection structures 656, which can allow connections to a fixture mounting surface or a suspension mechanism, can be co-extruded or later connected to the lighting fixture 652. The resulting lighting fixture 652 comprises a lighting fixture body 658 that also functions as a lens over a greater surface area and is unhindered by non-lens components 654.

The body 658 of lighting fixture 652 is now discussed in greater detail. FIG. 14 shows a lighting fixture 700, similar to lighting fixture 652 in FIG. 13 above. Lighting fixture 700 comprises a body 702 wherein portions of body 702 comprise a lens. In the embodiment shown, nearly the entirety of body 702 comprises a lens except for the opaque portion 704, created by the presence of PCB 706 and LEDs 708, one or more additional opaque portions 707 that can be used to further customize beam output, and one or more reflective portions 710, which can be created in a variety of ways including treatment with a reflective substance of coextrusion with a reflective white material as is described above. It is understood that while the presence of opaque portions 707 and reflective portions 710 is shown in FIG. 14, these portions are not strictly necessary and are not utilized in every embodiment according of the present disclosure. PCB 706 can be electrically accessed via an opening on the top portion of body 702 (not shown), for example via the suspension mechanism as discussed above, or it can be accessed at the end portions of body 702. As with lighting fixture 652 above, lighting fixture 700 can further comprise connection structures 711, which can allow connections to a fixture mounting surface or a suspension mechanism.

It is understood that although the embodiment shown in FIG. 15 shows a primarily translucent body 702, in other embodiments body 702 can comprise various translucent, transparent, opaque, reflective and/or diffusive areas to customize the light output profile in a number of different ways. These various portions can be formed in many different ways known in the art. Some ways in which these portions can be formed include extrusion and coextrusion, forming portions separately and later connecting them to the body 102 (e.g. via adhesive, snap fit structure, or pressing the separately formed portion into the body during extrusion) and utilizing a coating with the desired properties. Additional, methods for imparting the above properties to body 702 are discussed above and also set forth in U.S. patent application Ser. No. 13/782,820 to Mark Dixon et al., also entitled Integrated Linear Light Fixture, filled on Mar. 1, 2013, which has been expressly incorporated by reference herein.

The lighting element 712, comprising PCB 706 and LEDs 708, is mounted on lighting element mounting surface 714. Lighting element 712 can be mounted to lighting element mounting surface 714 by an appropriate mounting means known in the art, including bonding or the use of various adhesives. Body 702 can comprise additional structures for securing the lighting element to mounting surface 714, for example securing structures 715, which are similar to securing structures 212 in FIG. 4 above. In some embodiments, body 702 further comprises a tabbed structure as shown above or other various structural components designed to accept or receive a lighting element. The surface opposite 716 the lighting element mounting surface 714, which is typically the fixture mounting surface in suspended fixture embodiments, is typically obscured by a shadowed area 717 when the lighting fixture 700 is not in operation.

As discussed above, fixture 700 can improve uplight emission by increasing the lateral profile width 718 of the body 702 and/or providing lens portions 720 in the upward-facing portions of body 702, which are translucent or transparent. By increasing the lateral profile width 718, more surface area of the lens can interact with rays of incident light at a distance further out in a lateral direction. Such incident light can be redirected (e.g. by reflection or refraction) in a direction that will illuminate the surface opposite 716 the lighting element mounting surface 714. In one embodiment, the lateral profile is increased by a distance greater than the width 722 of the lighting element mounting surface 714. Additionally, uplight emission can be increased by providing a translucent or transparent lens portion 720 in the upward facing portions of body 702, allowing for additional light to pass through such portions and illuminate the surface opposite 716 the lighting element mounting surface 714.

The above described interaction of light with the lens arrangement is depicted in FIG. 15, which shows a light fixture 750 similar to lighting fixture 700 above, wherein the corresponding disclosure above is incorporated into this embodiment such that like features share the same reference numbers. Lighting fixture 750 comprises a body 702, reflective portion 710 and lighting element 712. FIG. 15 shows light ray 752 which emits downward and passes through body 702.

FIG. 15 further shows light ray 754 which can interact with portions of body 702 that have been expanded laterally. Even when interacting with transparent portions 756 of body 702, wherein light ray 754 can be freely emitted from body 702, for example, as light ray 758, light ray 754 can experience total internal reflection at one or more of points of the transparent portion and be emitted toward the surface opposite 716 the lighting element mounting surface 714, for example as light ray 760, illuminating shadowed area 717.

Light can also interact with diffusive portions 762 of body 702. FIG. 15 shows light ray 764 which interacts with the diffusive portions 762 of body 702 and is refracted in multiple directions 766, including a direction 768 toward shadowed area 717. Light can also interact with features of lighting fixture 700 in additional ways. FIG. 15 further shows light ray 768 which interacts with and is reflected by reflective portion 710 and is emitted through a translucent upward portion of body 702. Reflective portion 710 can be arranged to direct emitted light toward the surface opposite 716 the lighting element mounting surface 714.

The expanded lateral profile lighting fixture can be utilized with a suspension mechanism and configured into a linear suspended arrangement. FIG. 16 shows a lighting fixture 800, similar to lighting fixture 700 and lighting fixture 750 above, comprising a body 802, a suspension mechanism 804, a power supply cover 806 an LED based lighting element 808 and electrical connections 810. Although FIG. 16 shows electrical connections 810 being provided at the end portions of body 802, it is understood that these connections can be provided in many different ways, for example via the suspension mechanism 804 as discussed above.

Figure 17:
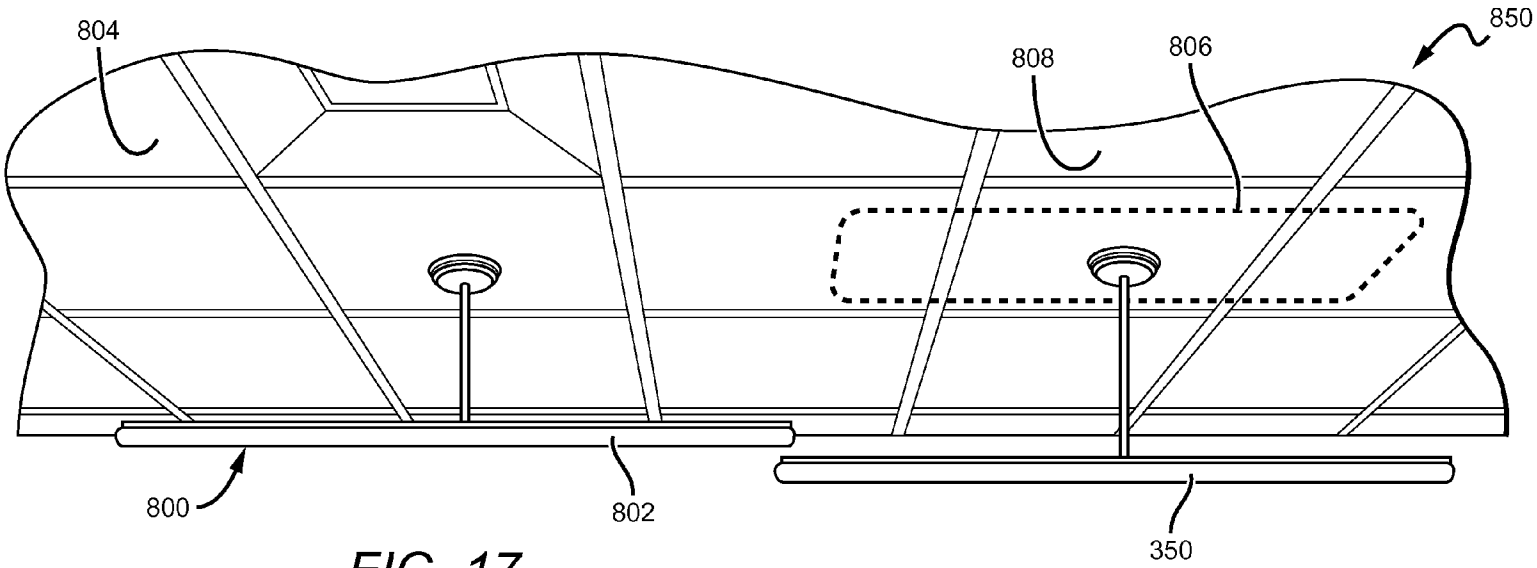
FIG. 17 is a side perspective view comparing a base lighting fixture that can be utilized with the present disclosure and the lighting fixture of FIG. 15 during operation.

The expanded lateral lens arrangement greatly improves uplight illumination. FIG. 17 shows a side perspective view of a comparison 850 comparing the base lighting fixture 350 of FIG. 7, with an expanded lateral profile lighting fixture 802 as shown in FIGS. 14-16. As can be seen in FIG. 17, there is significant improvement in uplight illumination represented by the lack of a dark shadowed area on the fixture mounting surface 804, which corresponds to lighting fixture 802, when compared with shadowed area 806 on lighting fixture mounting surface 808, corresponding to lighting fixture 350. This improvement to illuminance due to the increased lateral profile of the lens is also measurable. As above, the illuminance of the base lighting fixture 350 was 50 lux over the center viewing angle. The illuminance of the lighting fixture 802, was 240 lux over the center viewing angle.

Figure 18:
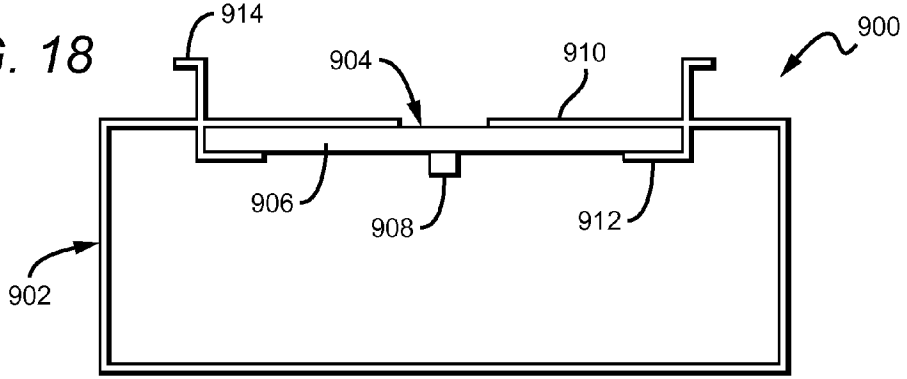
FIG. 18 is a front sectional view of one embodiment of a lighting fixture according to the present disclosure.

While the expanded lateral profile lens arrangement lighting fixtures have been depicted in an oblong, oval or elliptical shape, it is understood that the lenses can be arranged in any number of shapes that control or direct light such that it is emitted in an upward direction. For example, the lens can be the shape of any regular polygon or can comprise a number of irregular shapes, some of which are described below. FIG. 18 shows a lighting fixture 900 comprising a body 902 (wherein one or more portions can function as a lens), a lighting element 904 comprising a PCB 906 and LEDs 908, an lighting element mounting surface 910, securing structures 912 and connection mechanisms 914. As can be seen in FIG. 18, lighting fixture 900 has an increased lateral profile such that it can provide the benefits of the oblong shaped fixtures discussed above. One advantage of having a uniform shape, such as the rectangular shape depicted in FIG. 18, is that it is such regular designs are more consistent across their lens surfaces, making it easier to direct light in a desired manner, for example, through use of the addition of reflective portions.

The various lens arrangements can further be utilized to affect the output beam profile at a primary emission surface. FIG. 19 shows a lighting fixture 950 comprising a body 952 (wherein one or more portions can function as a lens), a lighting element 954 comprising a PCB 956 and LEDs 958, an lighting element mounting surface 960, securing structures 962 and connection mechanisms 964. Lighting fixture 950 comprises a primary emission surface 966. By having LED 958 a greater distance from the primary emission surface 966 than in other embodiments, the beam angle at the emission surface can be narrowed while still maintain the expanded lateral dimensions 968. One example advantage of utilizing a narrower beam angle is that a narrower area, such as an aisle, can have more emitted light directed toward it even if a lighting fixture is connected to a higher ceiling.

Many other irregular lens arrangements can be utilized. FIG. 20 shows a lighting fixture 1000 comprising a body 1002 (wherein one or more portions can function as a lens), a lighting element 1004 comprising a PCB 1006 and LEDs 1008, an lighting element mounting surface 1010, securing structures 1012 and connection mechanisms 1014. Lighting fixture 1000 further comprises one or more "winged" structures 1016. Each of the winged structures 1016 can comprise a reflective portion 1018 that can direct incident light in an upward direction, thus increasing emitted uplight. Like lighting fixture 950 above, lighting fixture 1000 has an increased distance 1020 from LEDS 1008 its bottommost surface 1022, which can result in a narrower beam angle at that surface.

Still more irregular lens arrangements can be utilized in accordance with the present disclosure. FIG. 21 shows a lighting fixture 1050 comprising a body 1052 (wherein one or more portions can function as a lens), a lighting element 1054 comprising a PCB 1056 and LEDs 1058, an lighting element mounting surface 1060, securing structures 1062 and connection mechanisms 1064. Lighting fixture 1050 further comprises elongated lateral wings 1064 which can further comprise reflective portions 1066. Lighting fixture 1050 comprises a narrow bottom emission surface 1068, which when coupled with the lateral wings 1064 and reflective portions 1066, results in less light being emitted in a downward direction.

A triangular lens shaped lighting fixture 1100 is shown in FIG. 22. This fixture comprises a body 1102 and a lighting element 1104 (the lighting element comprising an LED 1106 and a PCB 1108). Body 102 comprises transparent or translucent top portions 1110 which allow light emitted from lighting element 1104 to provide uplight. To further increase the amount of uplight provided, lighting fixture 1100 can further comprise reflective body portions 1112 which can direct some of the emitted light in an upward direction. Like other embodiments discussed above, additional lighting elements 1114 can be included on the top portion of body 1102 to provide further uplight.

Body 1102 can further comprise dedicated areas 1116 for housing a power supply or other electrical or electronic components, as mentioned above additional electronic components can include, for example, current and voltage converters to condition the input voltage and current to drive the appropriate design voltage and current of the LED circuit. Various structures can be included in body 1102 to further arrange body 1102 in such a way that the housing of electronic components are facilitated. For example, various fin, wedge or securing structures (including structures similar to lighting element receiving structure 202 in FIG. 2 above) can be included in body 1102 to house the electronic components. Alternatively or additionally, these dedicated areas 1116 can be separated compartments that can be freely opened or closed, for example via snap-fit structures as discussed above and/or living hinges which will be discussed further below. The electronic components can also simply be bonded or connected to an inner portion of body 1102. Various vias and pathways can be formed, for example in body 1102, allowing the electronic components to be placed in electrical communication, for example utilizing wires or other conductive elements, with the lighting elements 1104, 1114. Portions of body 1102 can be made opaque 1118 to conceal the electronics for aesthetic reasons.

While FIG. 22 specifically displays dedicated areas 1116 for housing electronic components, as mentioned above, similar structures can be incorporated in other embodiments, including the embodiments previous mentioned.

While the present disclosure discusses the use of a PCB, with adjustments to body, lens, and/or the use of highly efficient LEDs as discussed above, it is possible to utilize a conductive element structure instead of a PCB. Such a conductive element structure can include, for example, copper wire, conductive rails, magnet wire, non-conductive materials selectively coated with conductive materials, flattened braided wire and flex circuits on polyamide film. These and other substitutes for a traditional PCB are discussed in detail in U.S. patent application Ser. No. 13/782,820 to Mark Dixon, et al., entitled Integrated Linear Light Engine, which has been incorporated in its entirety by reference above into the present application.

The conductive elements can be added to a body portion of a light fixture or light engine in many different ways. Such ways are described in detail in U.S. patent application Ser. No. 13/782,820 to Mark Dixon, et al., entitled Integrated Linear Light Engine, which has been incorporated in its entirety by reference above into the present application. Some of these ways include the conductive elements being bonded to the body via a conductive adhesive, being pressed into the body after the body is formed, and being added to the body simultaneously with body formation during an extrusion process.

Light sources, such as LEDs or LED packages, can be connected to the conductive elements in a variety of ways. For example, LEDs can be connected to the conductive elements using a conductive adhesive. An advantage of using a conductive adhesive is that it does not require heating of the conductive elements or the body to levels which can result in structure failure. Many different conductive adhesives can be used, for example Circalok™ 6972 and 6968 manufactured by Lord Corporation. Circalok™ 6968 has the advantage of having a cure time/temperature of approximately 1 hr/65° C., which is much less than that of solder reflow temperatures (which is potentially over 250° C.). When LEDs are bound to the conductive elements via a conductive adhesive, it is possible that the connection can be brittle and susceptible to bending or spatial displacement of the top portion of body. It may be necessary to adjust the flexion properties when designing the body in certain embodiments having pluralities of LEDs or conductive elements which are sensitive to structure flexing. The properties of the adhesive can also be adjusted to account for thermal expansion.

Additional methods of LED connection can include: the use of low-temperature solder, which can be utilized with laser heating which will not significantly disturb underlying structures; the use of solder with induction heating, for example, for the purpose of providing a fast and local bond; and the use of sonic/vibration welding. Additionally, in certain embodiments, including wherein conductive elements comprise flex circuits, traditional soldering can be used. Additional methods of LED connection to the conductive elements are described in detail in U.S. patent application Ser. No. 13/782,820 to Mark Dixon, et al., entitled Integrated Linear Light Engine, which has been incorporated in its entirety by reference above into the present application.

Such non-PCB embodiments as mentioned above are depicted in FIGS. 23-25. These drawings depict light engines that can be utilized with devices according to the present disclosure. These light engines can be directly connected to a mounting surface, integrated into other fixtures and suspended via a suspension mechanism similar to the fixture embodiments described above. FIG. 23 shows a light engine 1150 comprising body 1152 (which can be made of the same materials and formed utilizing the same processes as body 102 in FIG. 1 above), conductive elements 1154, light source 1156, reflective element 1157, lens portion 1158 connected to body 1152 by living hinge 1160 (which allows for lens portion 1158 to move in relation to body 1152), and connection mechanisms 1162 which allow for additional connections to other fixtures, suspension mechanisms and/or mounting surfaces. Lens portion 1158 can further comprise a lens connection portion 1164 arranged to interact or mate with a body connection portion 1166, for example in a snap-fit manner as described above. The lens portion 1158 provides sloping laterally expanded sides 1168 that increase the lateral profile of lighting fixture 1150.

Reflective element 1157 can be made reflective by any suitable means known in the art, for example, by making it reflective white or configuring it such as the other reflective surfaces described above. It is understood that light engine 1150 can comprise reflective element 1157, but does not need to comprise reflective element 1157. While, embodiments comprising reflective element 1157 can be advantageous by providing increased light emission in a desired direction, in the embodiments discussed in the present disclosure, the conductive elements 1154 can be directly on body 102 and the light sources 1156 can be directly on conductive elements 1154 or body 102 without a reflective element 1157 or any other intervening structure.

Living hinge 1160 can be formed integral to lens portion 1158 and body 1152, for example, during an extrusion or injection molding process. Living hinge 1160 comprises a thinned portion of the material body 1152 and/or lens portion 1158 are made from and allows the rigid portions of body 1152 and lens portion 1158 to bend along point where living hinge 1160 connects the two structures together. When lens portion 1158 is in its "open" configuration (as depicted in FIG. 23), lens portion 1158 is not substantially enclosing elements on the top surface of body 1152, for example, light source 1154 and conductive elements 1156. When lens portion 1158 is in its "closed" position, it is substantially enclosing elements on the surface of the body 1152.

While living hinge embodiments are discussed in relation to the non-PCB embodiments, it is understood that a separate lens portion connected to the body portion via a living hinge can be utilized with many embodiments of light engines and lighting fixtures according to the present disclosure, including embodiments incorporating a PCB. Furthermore, while lens or cover portions can be advantageous by providing protection to underlying components and by providing a lens to further direct and control emitted light, it is understood that light engines and lighting fixtures according to the present disclosure do not need to comprise a lens or cover and can simply comprise a body portion with a light source disposed thereon.

Figure 24:
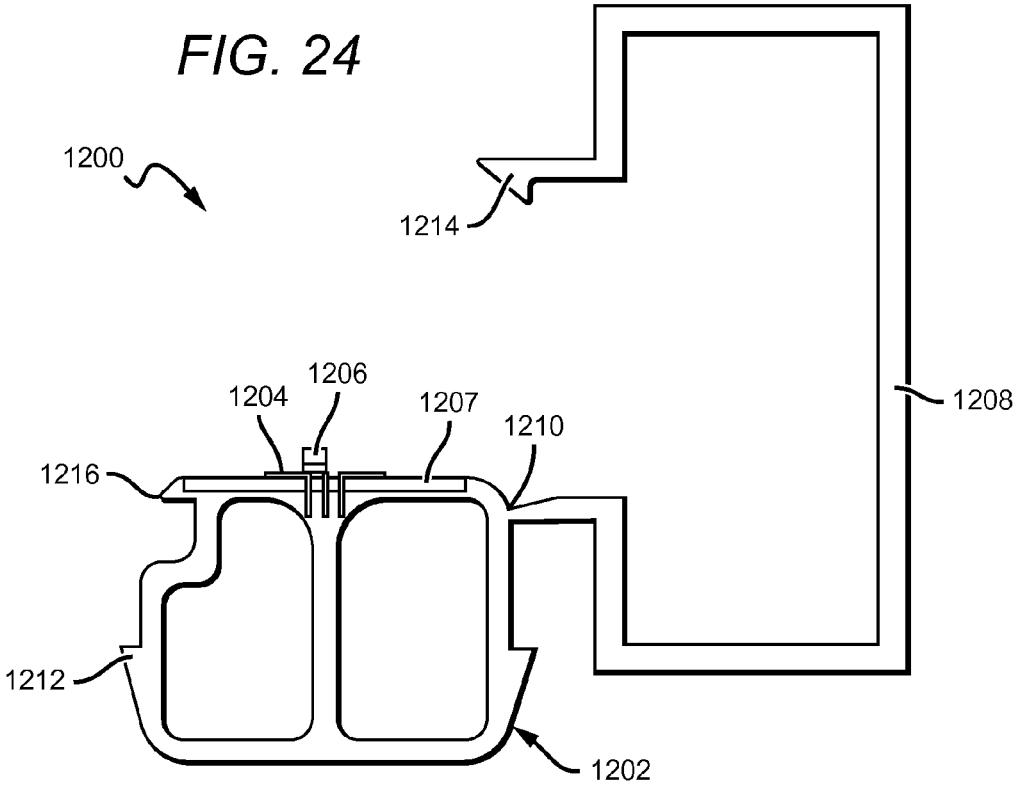
FIG. 24 is a front sectional view of one embodiment of a light engine that can be utilized with features according to the present disclosure.

FIG. 24 shows a light engine 1200, similar to light engine 1150 above, comprising body 1202(which can be made of the same materials and formed utilizing the same processes as body 102 in FIG. 1 above), conductive elements 1204, light source 1206, reflective element 1207, lens portion 1208 connected to body 1202 by living hinge 1210 (which allows for lens portion 1208 to move in relation to body 1202), connection mechanisms 1212, lens connection portion 1214 and body connection portion 1216. As shown in FIG. 24, lens portion 1208 is similar to the lens arrangement in FIG. 18 and likewise provides similar advantages to having a uniformly-shaped lens.

Figure 25:
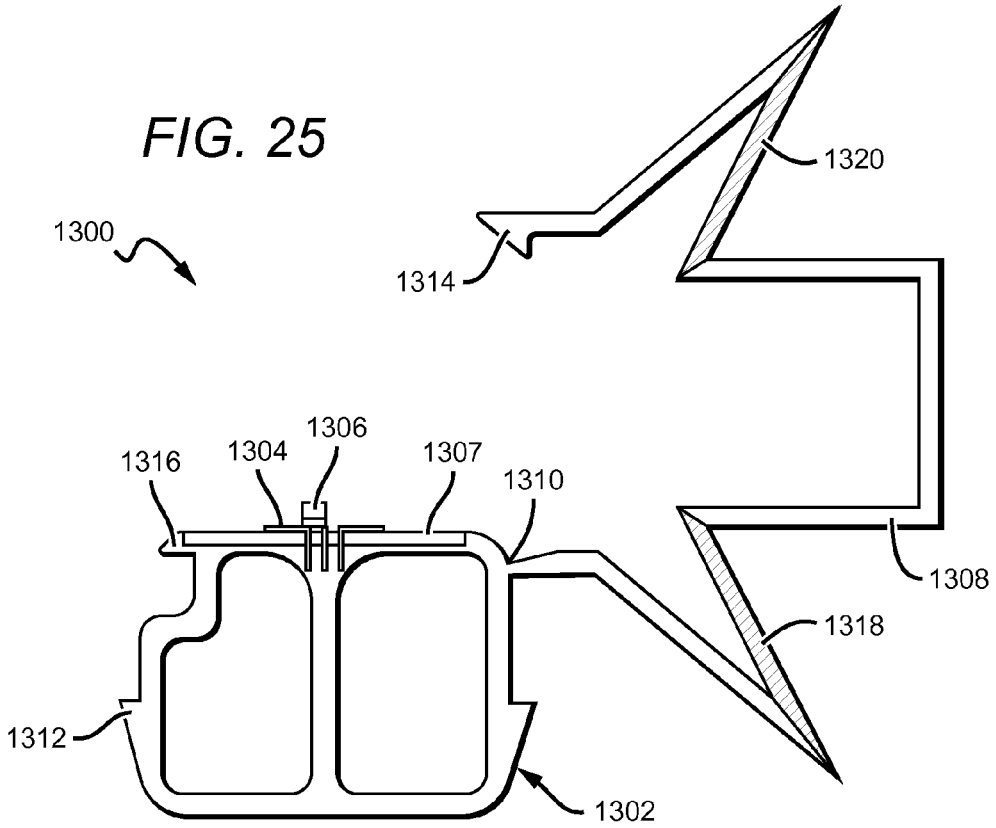
FIG. 25 is a front sectional view of one embodiment of a light engine that can be utilized with features according to the present disclosure.

FIG. 25 shows a light engine 1300, similar to light engine 1150 above, comprising body 1302(which can be made of the same materials and formed utilizing the same processes as body 102 in FIG. 1 above), conductive elements 1304, light source 1306, reflective element 1307, lens portion 1308 connected to body 1302 by living hinge 1310 (which allows for lens portion 1308 to move in relation to body 1302), connection mechanisms 1312, lens connection portion 1314 and body connection portion 1316. Light engine 1300 further comprises lateral winged portions 1318 which increase the lateral profile of lens portion 1308. Lateral winged portions 1318 comprise reflective portions, similar to reflective portions 1066 in FIG. 21 above. These reflective portions can direct emitted light in an upward direction, increasing uplight emission. In one embodiment, reflective portions 1320 comprise a reflective white material co-extruded with the material of body 1302 and lens 1308.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

We claim:

1. A lighting fixture, comprising:

an elongated body configured to receive at least one lighting element, wherein said body comprises a lens having at least one emission surface opposite a fixture mounting surface and at least one elongated support structure integral to said body to receive said at least one lighting element, wherein said body and said lens form a single integral component; and a suspension mechanism arranged to connect said body to said fixture mounting surface;

wherein said fixture is arranged to direct at least some light emitted by said at least one lighting element received by said elongated body toward a plane adjacent and parallel to said fixture mounting surface, wherein at least some light emitted from said fixture passes through said plane.

2. The lighting fixture of claim 1, wherein said lens comprises one or more reflective portions.

3. The lighting fixture of claim 1, wherein said lens comprises one or more opaque portions.

4. The lighting fixture of claim 1, further comprising said at least one lighting element, wherein said at least one lighting element comprises one or more LEDs.

5. The lighting fixture of claim 4, wherein said one or more LEDs are in contact with a printed circuit board ("PCB").

6. The lighting fixture of claim 1, wherein said lens comprises a shape having an extended lateral profile.

7. The lighting fixture of claim 1, wherein said lens further comprises extended winged portions.

8. The lighting fixture of claim 1, further comprising said at least one lighting element.

9. The lighting fixture of claim 8, wherein said lighting element comprises holes allowing light to be emitted in multiple directions.

10. The lighting fixture of claim 8, wherein said lighting element comprises LEDs mounted to at least two sides of said lighting element.

11. The lighting element of claim 10, wherein said lighting element comprises a double sided PCB.

12. The lighting fixture of claim 8, further comprising reverse mount LEDs.

13. The lighting fixture of claim 1, wherein said lens is connected to said body by a living hinge.

14. The lighting fixture of claim 1, wherein said body houses electronic components.

15. A lighting fixture, comprising:

an elongated body, wherein said elongated body comprises a lens portion which is integral to said body;

a suspension mechanism arranged to connect said body to a mounting surface; and at least one lighting element configured to direct at least some light emitted by said at least one lighting element toward a plane adjacent and parallel to said mounting surface, such that some of said directed light can exit said fixture and pass through said plane, wherein said at least one lighting element is received by at least one elongated support structure integral to said body.

16. The lighting fixture of claim 1, wherein said lighting element comprises LEDs.

17. The lighting fixture of claim 16, wherein said lighting element comprises reverse mount LEDs.

18. The lighting fixture of claim 16, wherein said LEDs are mounted to at least two sides of said lighting element.

19. The lighting element of claim 18, wherein said lighting element comprises a double sided PCB.

20. The lighting fixture of claim 15, wherein said lighting element comprises holes allowing light to be emitted in multiple directions.

21. The lighting fixture of claim 15, wherein said lighting element comprises a separate power strip of LEDs.

22. The lighting fixture of claim 15, wherein said body houses electronic components.

* * * * *